US009638390B2

(12) United States Patent
Wu et al.

(10) Patent No.: US 9,638,390 B2
(45) Date of Patent: May 2, 2017

(54) AXIALLY SYMMETRIC LED LIGHT BULB

(71) Applicant: UNITY OPTO TECHNOLOGY CO., LTD., New Taipei (TW)

(72) Inventors: Chih-Hsien Wu, New Taipei (TW); Sen-Yuh Tsai, New Taipei (TW); Chun-Chieh Huang, New Taipei (TW); Yu-Chang Chen, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 115 days.

(21) Appl. No.: 14/817,325

(22) Filed: Aug. 4, 2015

(65) Prior Publication Data

US 2016/0341367 A1 Nov. 24, 2016

(30) Foreign Application Priority Data

May 18, 2015 (TW) ..... 104207617

(51) Int. Cl.

| | |
|---|---|
| ***F21K 99/00*** | (2016.01) |
| ***F21V 19/00*** | (2006.01) |
| ***F21V 3/04*** | (2006.01) |
| ***F21V 3/02*** | (2006.01) |
| ***F21K 9/232*** | (2016.01) |
| ***F21K 9/66*** | (2016.01) |
| *F21Y 115/10* | (2016.01) |

(52) U.S. Cl.
CPC ..... *F21V 3/04* (2013.01); *F21K 9/232* (2016.08); *F21K 9/66* (2016.08); *F21V 3/02* (2013.01); *F21Y 2115/10* (2016.08)

(58) Field of Classification Search
CPC ..... F21V 3/02; F21V 3/04; F21K 9/232
See application file for complete search history.

(56) References Cited

U.S. PATENT DOCUMENTS

| | | | | |
|---|---|---|---|---|
| 4,988,911 A * | 1/1991 | Miller | F21V 3/02 | 313/113 |
| 2011/0080096 A1* | 4/2011 | Dudik | F21V 29/2212 | 315/112 |
| 2011/0080742 A1* | 4/2011 | Allen | F21V 3/00 | 362/294 |
| 2014/0160762 A1* | 6/2014 | Dudik | G02B 5/0242 | 362/294 |

* cited by examiner

*Primary Examiner* — Elmito Breval
(74) *Attorney, Agent, or Firm* — Rosenberg, Klein & Lee

(57) ABSTRACT

An axially symmetric LED light bulb includes a lamp shade, a substrate and a connecting seat. The substrate installed on the connecting seat includes plural LED light sources. The lamp shade has an edge connected to the connecting seat, and the substrate is covered inside the lamp shade. The lamp shade has an unequal thickness with a thicker top and thinner sides. The axially symmetric LED light bulb provides excellent light uniformity and wide-angle illumination.

8 Claims, 10 Drawing Sheets

AXIALLY SYMMETRIC LED LIGHT BULB

CROSS-REFERENCE TO RELATED APPLICATIONS

This non-provisional application claims priority under 35 U.S.C. §119(a) on Patent Application No(s). 104207617 filed in Taiwan, R.O.C. on May 18, 2015, the entire contents of which are hereby incorporated by reference.

BACKGROUND OF THE INVENTION

1. Field of the Invention

The present invention relates to the field of LED light bulbs, and more particularly to an axially symmetric LED light bulb with the features of high light uniformity and wide-angle illumination range.

2. Description of the Related Art

LED with the features of high efficiency, high color rendering, environmental friendliness, energy saving and long service life is used generally used as a light source for various illumination lamps.

For example, the conventional light bulb at an early stage uses a tungsten filament as the light source, wherein electricity is passed through the tungsten filament, and the tungsten filament is heated to incandescence to emit light for the illumination purpose due to the resistance of the tungsten filament. The light emission of such light bulb is similar to that of a light source, so that when such light bulb is used for illumination, a luminous efficacy of 360-degree full-circumferential radiation is achieved. A s described above, LEDs are used extensively as a light source for lamps, but most of the light sources in the present LED light bulbs are designed with a light emitting surface facing upward and perpendicular to the light emitting angle. In the meantime, the shape and structure of the light bulb provides a screening effect to the light, so that the light emitting angle of the conventional LED light bulb is usually not too large, and the light is too concentrated and comes with a narrow light emitting angle. With the aforementioned restrictive properties including the light emitting angle and the total light lumen of the LED, the conventional LED light bulb is unable to achieve the full-circumferential uniform illumination effect like the conventional incandescent lamps with the feature of a uniform wide-angle light emission. Therefore, the conventional LED light bulb still requires improvements of the illumination angle and the uniformity of light to achieve a better illumination performance of the LED light bulb.

To improve the luminous efficacy of the LED light bulb, most manufacturers adopt a 3D light source to increase the illumination angle of the LED light bulb, such that the LED light bulb can achieve the effect of a full-circumferential illumination similar to that of the tungsten filament. With reference to FIGS. 1 to 4 for various types of conventional LED light bulbs 1 available in the market, the LED light bulb 1 adopts an LED light source 10 arranged in a vertical direction, such that the light output angle of the light emitted from the LED light bulb 1 may be increased. In FIG. 2, the LED light bulb 1 also adopts a vertically arranged LED light source 10. Compared with the LED light bulb 1 as shown in FIG. 1, the LED light bulb 1 as shown in FIG. 2 uses a greater number of LED light sources 10, so that a 3D light source with more surfaces produces and outputs more lights in different angles. In FIG. 3, the LED light bulb 1 is assembled by using a multi-angle circuit substrate 1, such that the lights of the LED light sources 10 may be emitted to different angles. In FIG. 4, a secondary optical lens 12 is added to the top of the LED light source 10 to achieve the effects of increasing the illumination angle and providing the full-circumferential radiation. However, the aforementioned method is commonly adopted in the LED light bulb with a light emitting surface facing upward, and it is necessary to design and consider the LED light source 10 again or even re-design the area for installing the LED light source 10 whenever the installation direction of the LED light source 10 is adjusted. In the LED light bulb 1 as shown in FIG. 1, there are just two areas for installing the LED light source 10, and thus there still exists an illumination angle unreachable by light. In the LED light bulb 1 as shown in FIGS. 2 and 3, such LED light bulb 1 is the present common 3D light source design. To improve the light output angle of the LED light source 10, it is necessary to increase the quantity of LED light sources 10, so that the quantity of lead frame or circuit substrates 12 for installing the LED light source 10 is increased accordingly, and the manufacturing and assembling costs are increased significantly. Although the light source is a 3D light source, the shape of the aforementioned LED light bulb 1 affects the light emitting angle of the LED light source 10, so that different LED light bulbs 1 require the lead frame or circuit substrates 11 which are designed one by one to comply with the required light output angle. In FIG. 4, some manufacturers adopt the method of installing an additional secondary optical lens 12 outside the LED light source 10, such that the illumination angle of the light is increased by the secondary optical lens 12. However, this method requires the installation of other components to the LED light bulb 1, and thus the manufacturing cost and assembling time are increased.

Therefore, the present methods adopted for improving the light output angle and uniformity of the LED light bulb increase the manufacturing cost, the assembling time and the level of difficulty of the design. Although these methods may overcome the issue of a low luminous efficacy of the LED light bulb, yet they still have the following drawbacks. Therefore, the inventor of the present invention provides an axially symmetric LED light bulb in hope of overcoming the drawbacks of the conventional LED light bulb and improving the illumination angle and light uniformity of the LED light bulb with planar light emission to omit the complicated design of the light source and lower the production cost.

SUMMARY OF THE INVENTION

Therefore, it is a primary objective of the present invention to provide an axially symmetric LED light bulb capable of adjusting the upward LED light output angle with respect to the light emitting surface and homogenizing the overall light uniformity to provide the wide-angle light emitting angle and excellent illumination uniformity similar to those of a full-circumferential radiation.

To achieve the aforementioned and other objectives, the present invention provides an axially symmetric LED light bulb comprising a lamp shade, a substrate and a connecting seat, and the substrate being installed on the connecting seat and having a plurality of LED light sources, and an edge of the lamp shade being coupled to the connecting seat and the substrate being covered inside the lamp shade, characterized in that the lamp shade has an unequal thickness, and the thickness of the top of the lamp shade is greater than the thickness of the lateral side of the lamp shade, such that the LED light source is arranged at a polar coordinate origin position, and when the illumination of LED light source points at a direction towards the polar coordinate 0 degree and after the light of the LED light source passes through the lamp shade, at least 5% of the total flux of the LED light source is obtained at the polar coordinate position from 135 degrees to 180 degrees. The axially symmetric LED light bulb 2 further satisfy a illumination relation (|I−Iavg|/Iavg) <25%, wherein I is an intensity of light of at least 90% of a spatial position between 0 degree to 135 degrees of the polar coordinate positions, and Iavg is an average light intensity situated between the polar coordinate position from 0 degree to 135 degrees.

Wherein, the ratio of the thickness of the lamp shade at the polar coordinates from +30 degrees to −30 degrees to the thickness of the lamp shade at the polar coordinates from +90 degrees to +30 degrees and from −90 degrees to −30 degrees is equal to (1.8−3):1. Within this range, the present invention meets the conditions of the optimal light uniformity and wide-angle illumination angle and achieves the best lighting performance.

In addition, the cross-sectional edge of the inner side of the lamp shade is arc-shaped or is a curve with a plurality of turning points, and the curve is bilaterally symmetrical, and the distance from the top end of the inner side of the lamp shade to the substrate is equal to 50 mm-60 mm, and the maximum width of the external periphery of the lamp shade is equal to 58 mm-70 mm.

In summation of the description above, the axially symmetric LED light bulb of the present invention effectively improves the luminous efficacy of a light bulb that uses LED as a light source, and the lamp shade with unequal thickness reduces a too-strong light of the LED light source generated at specific angles, so that the light of the light bulb at a predetermined light output angle is more uniform and the illumination angle is wider.

DETAILED DESCRIPTION OF THE PREFERRED EMBODIMENTS

The technical content of the present invention will become apparent with the detailed description of preferred embodiments and the illustration of related drawings as follows. It is noteworthy that same numerals are used for representing the same respective elements respectively for simplicity.

Figure 1:
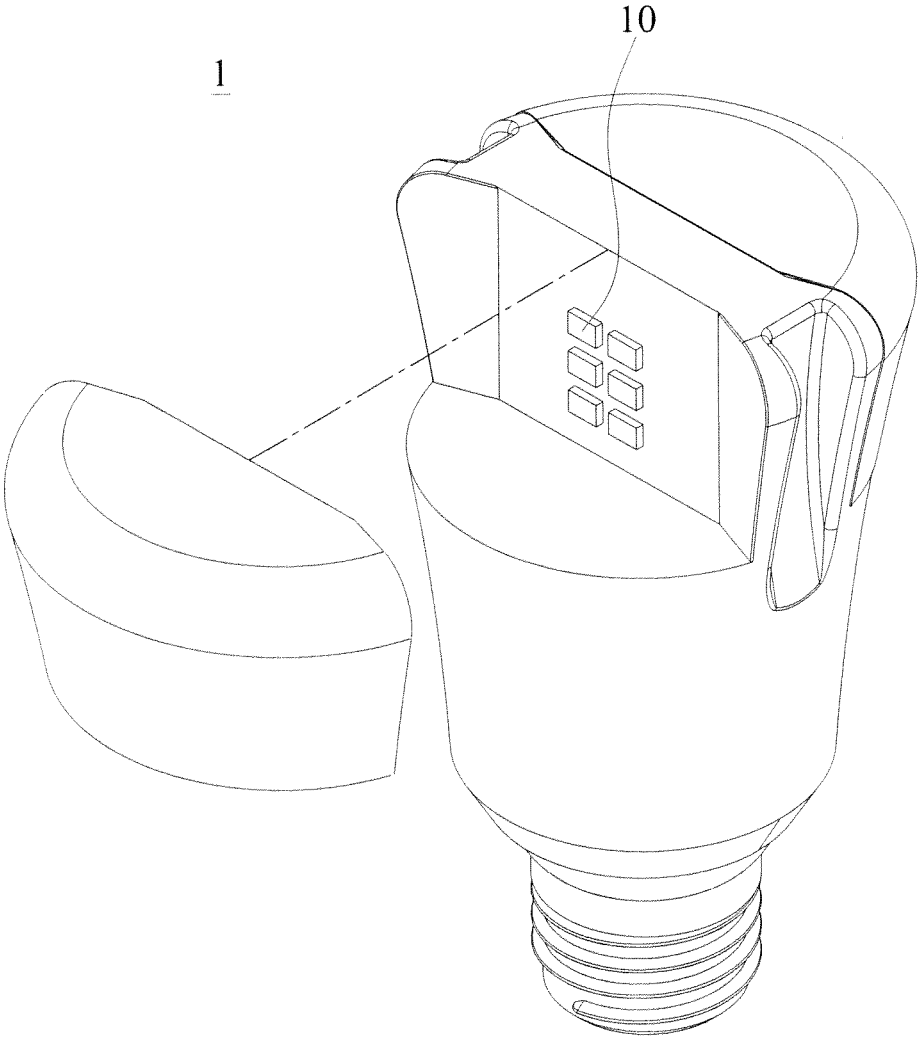
Fig. 1(PRIOR ART)
FIG. 1 is a schematic view of a first conventional LED light bulb.
Figure 2:
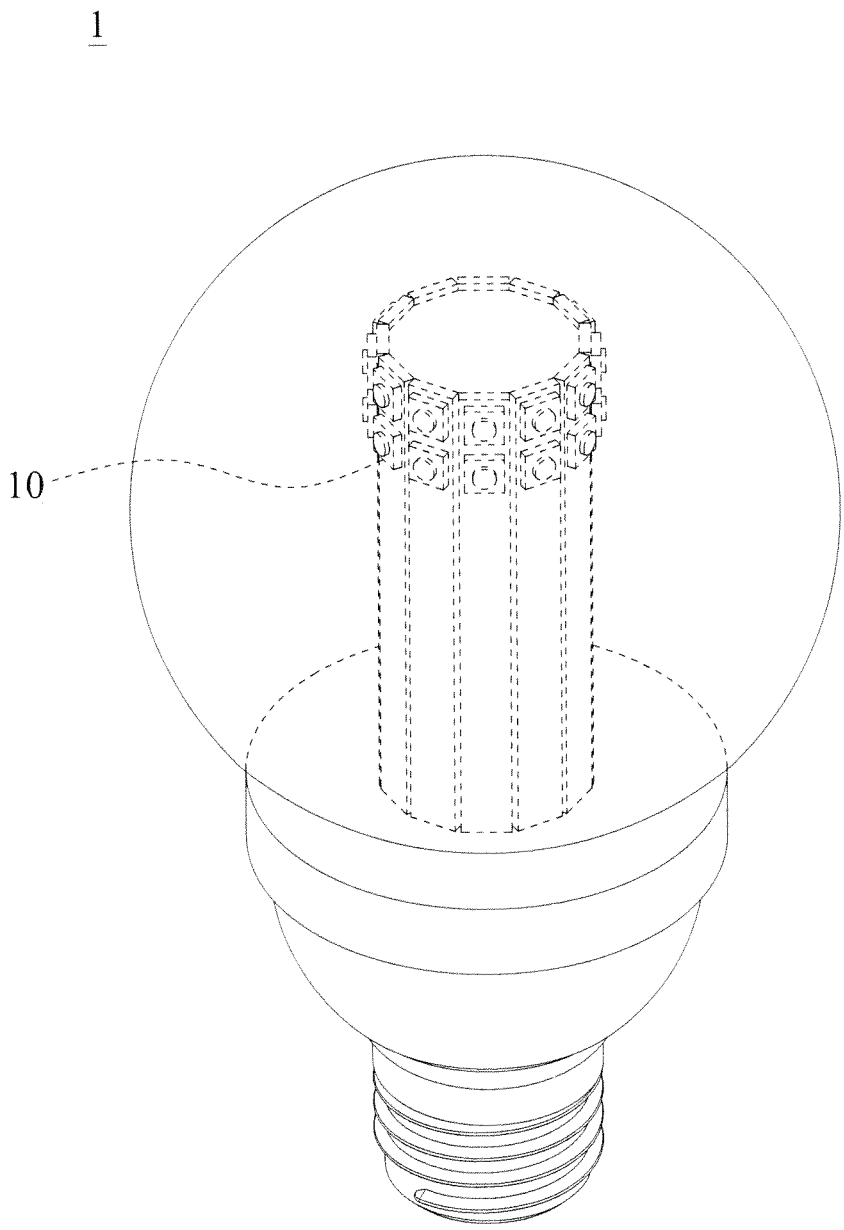
Fig. 2(PRIOR ART)
FIG. 2 is a schematic view of a second conventional LED light bulb.
Figure 3:
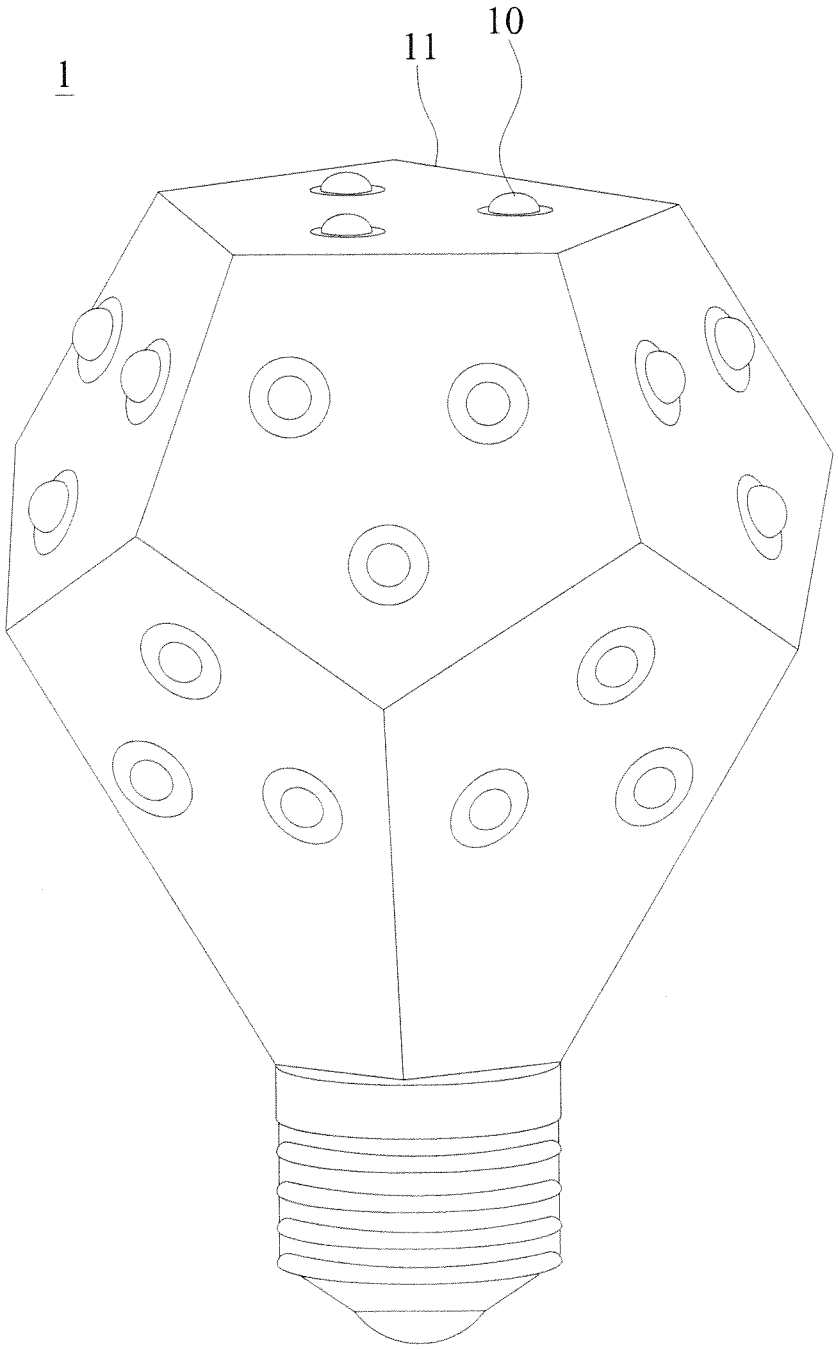
Fig. 3(PRIOR ART)
FIG. 3 is a schematic view of a third conventional LED light bulb.
Figure 4:
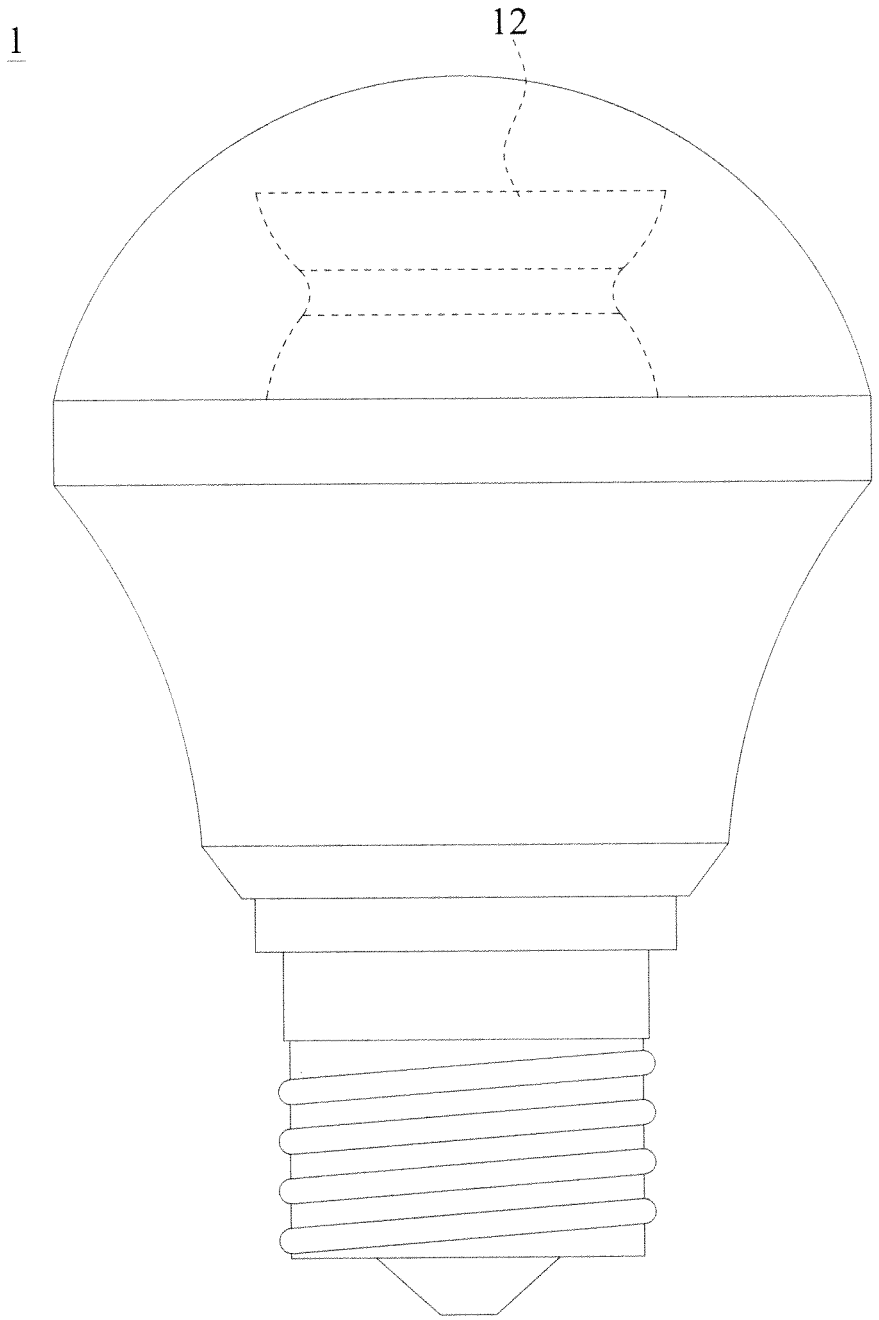
Fig. 4(PRIOR ART)
FIG. 4 is a schematic view of a fourth conventional LED light bulb.
Figure 5:
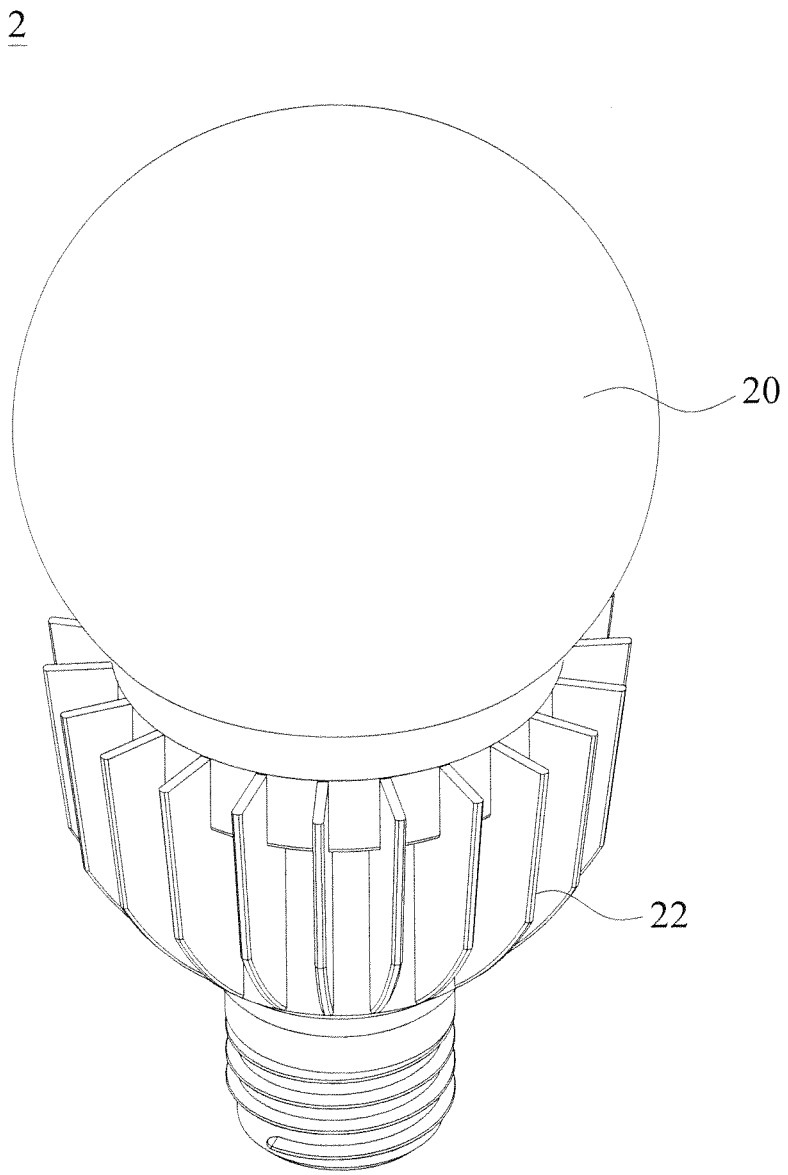
FIG. 5 is a perspective view of an axially symmetric LED light bulb of a preferred embodiment of the present invention.
Figure 6:
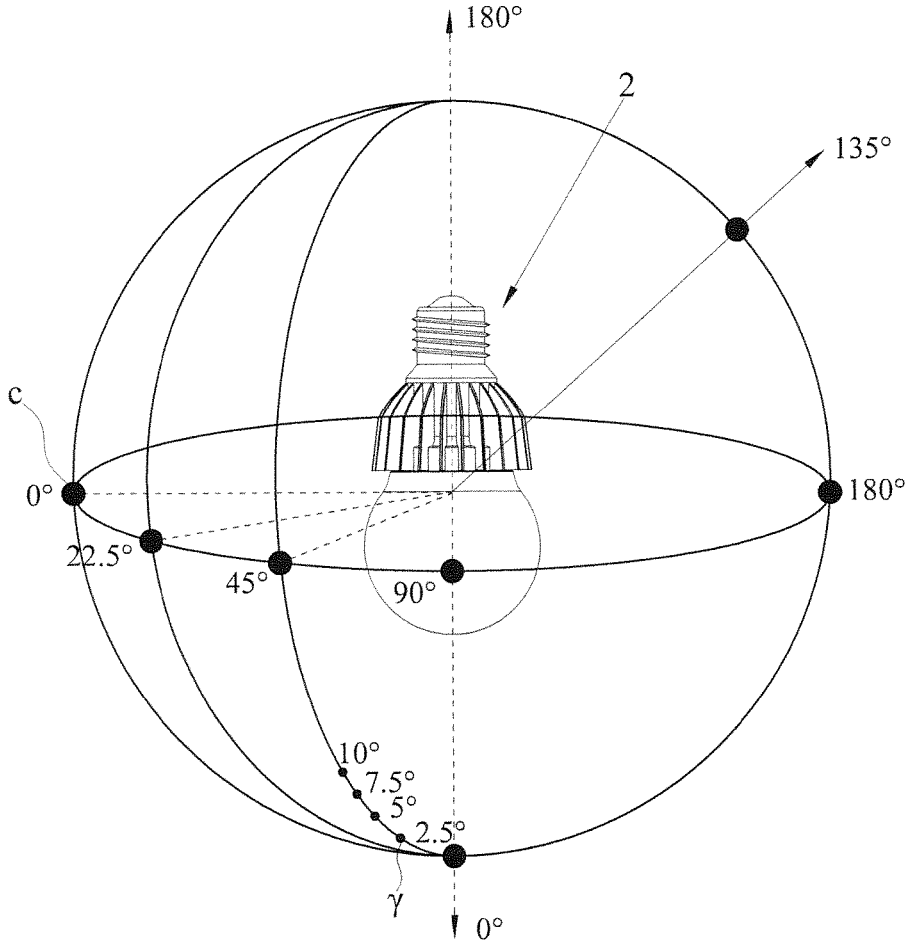
FIG. 6 is a schematic view showing the polar coordinate space of an axially symmetric LED light bulb of a preferred embodiment of the present invention.
Figure 7:
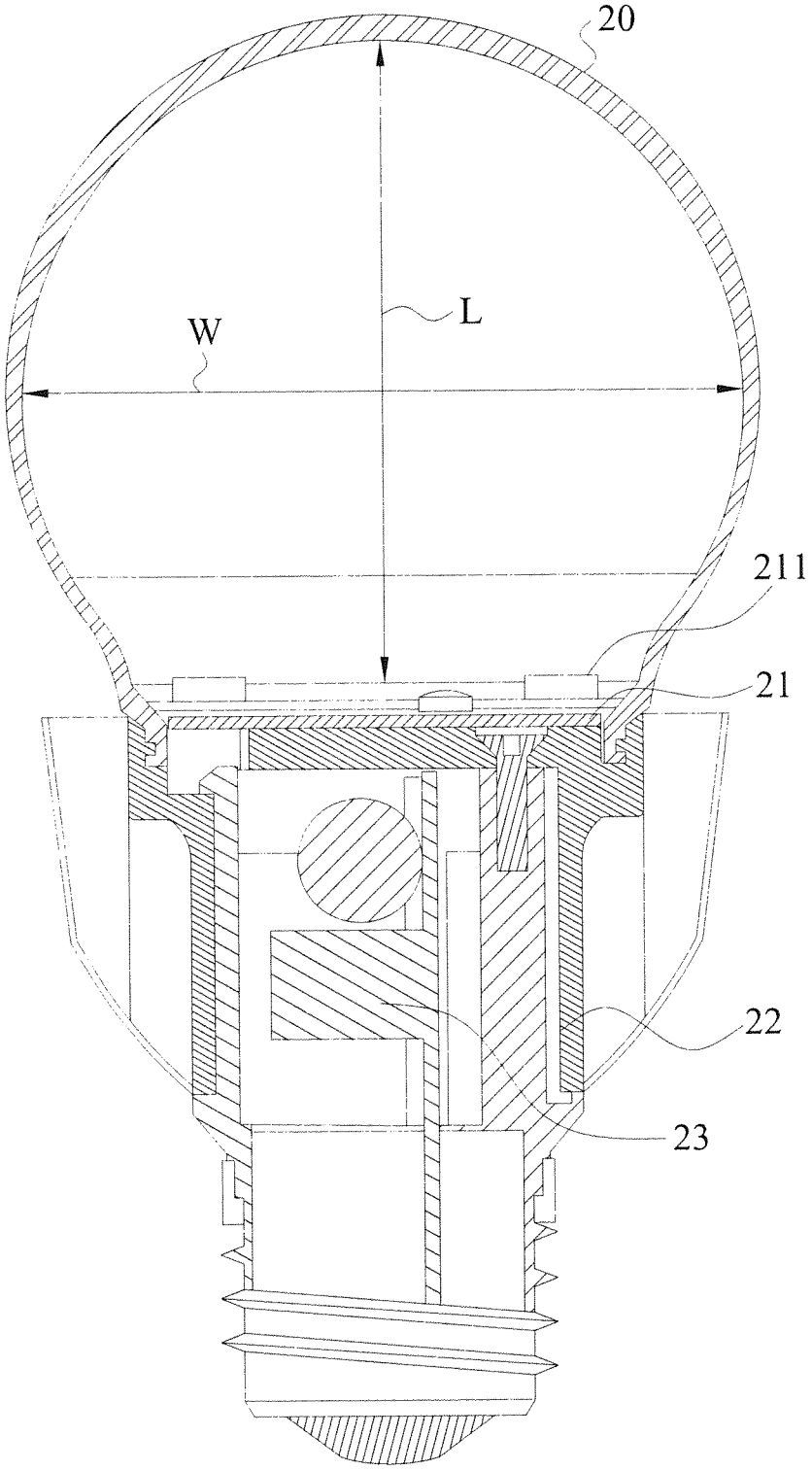
FIG. 7 is a cross-sectional view of an axially symmetric LED light bulb of a preferred embodiment of the present invention.

With reference to FIGS. 5, 6 and 7 for a perspective view of an axially symmetric LED light bulb, a schematic view showing the polar coordinate space of the axially symmetric LED light bulb, and a cross-sectional view of the axially symmetric LED light bulb in accordance with a preferred embodiment of the present invention respectively, the axially symmetric LED light bulb 1 comprises a lamp shade 20, a substrate 21 and a connecting seat 22, and the substrate 21 is disposed on the connecting seat 22 and includes a plurality of LED light sources 211 used as a light source, and a power supply element 23 is installed in the connecting seat 22 for supplying electric power to the LED light sources 211, and an end of the lamp shade 20 is connected to the connecting seat 22, and the substrate 21 is covered inside the lamp shade 20.

The axially symmetric LED light bulb 2 is characterized in that the lamp shade 20 has an unequal thickness, wherein the thickness of the top of the lamp shade 20 is greater than the thickness of the lateral side of the lamp shade 20, so that the lamp shade 20 comes with an unequal thickness. Please refer to FIG. 6, for purpose of explanation, the LED light sources 211 are arranged at an origin position of a polar coordinate, and the LED light sources 211 are pointing in a direction toward the polar coordinate 0 degree. After the lights of the LED light sources 211 pass through the lamp shade, the flux between the polar coordinate from 135 degrees to 180 degrees is equal to at least 5% of the total flux of the LED light source. The axially symmetric LED light bulb 2 further satisfy a illumination relation (|I−Iavg|/Iavg) <25%, wherein I is an intensity of light of at least 90% of a spatial position between 0 degree to 135 degrees of the polar coordinate positions, and Iavg is an average light intensity situated between the polar coordinate position from 0 degree to 135 degrees, so that the light emission of the axially symmetric LED light bulb 2 has better uniformity and wider illumination range to achieve the 360-degree full-circumferential radiation effect. The greater the thickness of the lamp shade 20, the better is the light reflection effect. In other words, a greater thickness has a better chance to achieve the full-circumferential radiation effect. Meanwhile, the light intensity and brightness of the LED light sources 211 projected onto the lamp shade 20 will become weaker accordingly, so that the light of the LED light sources 211 has an increasingly weaker light intensity and an increasingly wider illumination angle as the thickness of the lamp shade 20 increases. On the hand, the light of the LED light sources 211 has an increasingly stronger light intensity and an increasingly narrower illumination angle as the thickness of the lamp shade 20 decreases. Obviously, the light shows a progressive change of intensity and illumination angle with the thickness of the lamp shade 20. Therefore, the light emitting angle and the light intensity of the LED light sources 211 may be changed by adjusting the thickness of the lamp shade 20. To achieve a better illumination effect of the axially symmetric LED light bulb 2 to meet the aforementioned flux and light intensity requirements, the thickness ratio of the lamp shade 20 may be further defined.

The following data are obtained from optical experiments, and these data relate to the thickness ratios of the lamp shade 20 (hereinafter referred to as "thickness ratio") at the polar coordinate from +30 degrees to −30 degrees with respect to the polar coordinate +90 degrees to +30 degrees and −90 degrees to −30 degrees. The thickness of the lamp shade 20 at the polar coordinate from +30 degrees to −30 degrees and the thickness of the lamp shade 20 at the polar coordinate from +90 degrees to +30 degrees and from −90 degrees to −30 degrees are obtained after conducting the optical experiments, and if their ratio is equal to (1.8−3):1, the aforementioned restrictive condition of the flux and the light emitting intensity is met, and the axially symmetric LED light bulb 2 achieves the effects of full circumferential luminous efficacy and light uniformity.

Firstly, optical experiments on testing whether or not the light emitting intensity satisfies the relation (|I−Iavg|/Iavg) <25% are conducted repeatedly, and the experiment results are listed in Tables 1-1 to 1-5. Wherein, Tables 1-1 to 1-5 show the numeric values of the measured light intensity at the polar coordinate positions (γ,c) and the measured average light intensity Iavg as shown in FIG. 6.

Table 1-1 lists the experiment data provided that the thickness ratio of the lamp shade 20 is 1:1 and shows the light emitting intensity I at each spatial position within the polar coordinate positions from 0 degree to 135 degrees and the numeric value of (|I−Iavg|/Iavg) of the average light intensity Iavg; Table 1-2 lists the experiment data provided that the thickness ratio of the lamp shade 20 is 1.7:1, and shows the light emitting intensity I at each spatial position within the polar coordinate positions from 0 degree to 135 degrees and the numeric value of (|I−Iavg|/Iavg) of the average light intensity Iavg; Table 1-3 lists the experiment data provided that the thickness ratio of the lamp shade 20 is 1.8:1, and shows the light emitting intensity I at each spatial position within the polar coordinate positions from 0 degree to 135 degrees and the numeric value of (|I−Iavg|/Iavg) of the average light intensity Iavg; Table 1-4 lists the experiment data provided that the thickness ratio of the lamp shade 20 is 3:1, and shows the light emitting intensity I at each spatial position within the polar coordinate positions from 0 degree to 135 degrees and the numeric value of (|I−Iavg|/Iavg) of the average light intensity Iavg; and Table 1-5 lists the experiment data provided that the thickness ratio of the lamp shade 20 is 3.1:1, and shows the light emitting intensity I at each spatial position within the polar coordinate positions from 0 degree to 135 degrees and the numeric value of (|I−Iavg|/Iavg) of the average light intensity Iavg, wherein the numeric values listed in each table is in the unit of %.

TABLE 1-1

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 0 | 17.91 | 18.03 | 17.91 | 17.85 | 17.91 | 18.21 | 18.09 | 18.26 | 18.44 | 18.03 | 17.91 | 17.85 | 17.91 | 18.21 | 18.09 | 18.26 | 17.91 |
| 2.5 | 18.44 | 17.91 | 17.62 | 17.58 | 19.31 | 19.73 | 19.94 | 22.65 | 23.42 | 25.03 | 25.72 | 26.71 | 24.66 | 23.53 | 22.08 | 19.26 | 18.44 |
| 5 | 18.38 | 17.91 | 17.56 | 17.64 | 19.37 | 19.61 | 19.88 | 22.35 | 23.30 | 24.78 | 25.66 | 26.27 | 24.60 | 23.28 | 22.08 | 18.96 | 18.38 |
| 7.5 | 18.32 | 17.68 | 17.56 | 17.70 | 19.26 | 19.55 | 20.06 | 22.04 | 23.05 | 24.60 | 25.28 | 26.01 | 24.22 | 23.28 | 21.96 | 18.96 | 18.32 |
| 10 | 18.09 | 17.68 | 17.39 | 17.41 | 19.20 | 19.43 | 19.71 | 21.80 | 22.87 | 24.29 | 24.84 | 25.70 | 23.73 | 22.91 | 21.65 | 18.90 | 18.09 |
| 12.5 | 18.03 | 17.62 | 17.09 | 17.23 | 18.72 | 19.25 | 19.41 | 21.62 | 22.62 | 23.79 | 24.40 | 24.82 | 23.54 | 22.61 | 21.41 | 18.79 | 18.03 |
| 15 | 17.74 | 17.33 | 16.92 | 17.17 | 18.66 | 19.01 | 19.29 | 21.07 | 21.95 | 23.29 | 23.96 | 24.37 | 23.17 | 22.11 | 20.80 | 18.19 | 17.74 |
| 17.5 | 17.56 | 17.03 | 16.63 | 16.94 | 18.24 | 18.83 | 18.93 | 20.77 | 21.64 | 22.73 | 23.65 | 24.06 | 22.61 | 21.74 | 20.38 | 17.96 | 17.56 |
| 20 | 17.32 | 16.74 | 16.28 | 16.70 | 17.95 | 18.30 | 18.57 | 20.10 | 21.27 | 22.05 | 22.71 | 23.55 | 22.11 | 21.07 | 19.89 | 17.72 | 17.32 |
| 22.5 | 16.86 | 16.33 | 16.10 | 16.06 | 17.77 | 17.70 | 17.85 | 19.85 | 20.53 | 21.67 | 22.21 | 22.61 | 21.49 | 20.33 | 19.77 | 17.31 | 16.86 |
| 25 | 16.33 | 16.04 | 15.87 | 15.77 | 17.06 | 17.34 | 17.68 | 19.00 | 19.98 | 20.80 | 21.58 | 21.79 | 20.75 | 20.08 | 19.16 | 17.07 | 16.33 |
| 27.5 | 15.86 | 15.68 | 15.05 | 15.47 | 16.64 | 16.93 | 17.08 | 18.33 | 19.00 | 20.05 | 20.70 | 20.97 | 20.13 | 19.28 | 18.86 | 16.18 | 15.86 |
| 30 | 15.80 | 15.39 | 14.64 | 15.00 | 16.04 | 16.33 | 16.66 | 18.09 | 18.63 | 18.87 | 19.70 | 20.21 | 19.32 | 18.91 | 18.07 | 15.95 | 15.80 |
| 32.5 | 15.33 | 15.04 | 15.05 | 14.71 | 15.69 | 15.74 | 15.76 | 17.23 | 17.77 | 18.37 | 19.01 | 19.26 | 18.64 | 18.30 | 17.28 | 15.35 | 15.33 |
| 35 | 15.15 | 14.57 | 14.40 | 14.13 | 15.33 | 14.90 | 15.59 | 16.69 | 17.10 | 17.69 | 18.25 | 18.63 | 18.27 | 17.62 | 17.22 | 15.24 | 15.15 |
| 37.5 | 14.80 | 14.45 | 14.29 | 14.07 | 15.15 | 14.90 | 15.11 | 16.02 | 16.36 | 16.82 | 17.37 | 18.00 | 17.34 | 17.31 | 16.73 | 14.88 | 14.80 |
| 40 | 14.62 | 14.10 | 14.11 | 13.89 | 14.74 | 14.31 | 14.57 | 15.47 | 15.75 | 16.19 | 16.31 | 17.31 | 16.28 | 16.82 | 16.12 | 14.70 | 14.62 |
| 42.5 | 14.15 | 13.69 | 13.64 | 13.31 | 14.32 | 14.43 | 13.91 | 14.86 | 15.20 | 15.39 | 15.81 | 16.55 | 15.73 | 15.59 | 15.27 | 13.99 | 14.15 |
| 45 | 13.74 | 13.57 | 13.35 | 12.84 | 13.73 | 13.41 | 13.26 | 14.13 | 14.52 | 14.64 | 14.87 | 15.48 | 15.17 | 15.22 | 14.73 | 13.82 | 13.74 |
| 47.5 | 13.57 | 13.04 | 12.82 | 12.72 | 13.61 | 12.82 | 12.72 | 13.52 | 13.79 | 13.77 | 13.99 | 14.47 | 14.42 | 14.60 | 14.54 | 13.17 | 13.57 |
| 50 | 13.16 | 12.87 | 12.71 | 12.43 | 12.83 | 12.52 | 12.18 | 13.16 | 12.93 | 13.15 | 12.92 | 13.71 | 13.62 | 13.87 | 13.75 | 12.81 | 13.16 |
| 52.5 | 12.51 | 12.46 | 12.18 | 11.84 | 12.30 | 11.75 | 11.71 | 12.24 | 12.07 | 12.21 | 12.17 | 12.83 | 12.75 | 12.94 | 13.21 | 12.22 | 12.51 |
| 55 | 12.16 | 12.10 | 11.83 | 11.37 | 12.00 | 11.33 | 10.87 | 11.45 | 11.39 | 11.22 | 11.29 | 12.01 | 11.76 | 12.39 | 12.48 | 11.63 | 12.16 |
| 57.5 | 11.57 | 10.99 | 11.01 | 10.91 | 10.81 | 10.20 | 10.33 | 10.54 | 10.47 | 10.10 | 10.04 | 10.74 | 10.64 | 11.34 | 11.57 | 11.27 | 11.57 |
| 60 | 10.75 | 10.64 | 10.31 | 10.14 | 9.92 | 9.72 | 9.50 | 9.81 | 9.37 | 9.16 | 9.16 | 9.48 | 9.52 | 10.11 | 10.84 | 10.21 | 10.75 |
| 62.5 | 10.16 | 9.93 | 9.90 | 9.21 | 9.21 | 8.77 | 8.78 | 8.77 | 8.45 | 8.17 | 8.28 | 8.22 | 8.78 | 9.25 | 9.80 | 9.62 | 10.16 |
| 65 | 9.22 | 9.29 | 8.96 | 8.50 | 8.38 | 8.12 | 7.82 | 8.04 | 7.41 | 6.92 | 6.90 | 7.34 | 7.23 | 8.02 | 8.89 | 8.55 | 9.22 |
| 67.5 | 8.16 | 8.00 | 7.97 | 7.39 | 7.54 | 7.28 | 6.69 | 6.77 | 6.24 | 5.80 | 5.52 | 5.95 | 6.36 | 6.79 | 7.56 | 7.78 | 8.16 |
| 70 | 7.28 | 7.24 | 7.03 | 6.57 | 6.53 | 5.97 | 5.62 | 5.30 | 5.14 | 4.43 | 4.51 | 4.37 | 4.94 | 5.49 | 6.46 | 6.84 | 7.28 |
| 72.5 | 6.11 | 6.06 | 6.03 | 5.40 | 5.23 | 5.20 | 4.66 | 4.39 | 3.85 | 3.31 | 3.32 | 3.11 | 3.63 | 4.39 | 5.49 | 5.65 | 6.11 |
| 75 | 4.93 | 4.95 | 4.81 | 4.46 | 4.15 | 3.65 | 3.47 | 2.99 | 2.68 | 1.76 | 1.63 | 1.78 | 2.14 | 3.09 | 4.03 | 4.65 | 4.93 |
| 77.5 | 3.82 | 3.60 | 3.58 | 3.06 | 2.97 | 2.40 | 2.03 | 1.83 | 1.03 | 0.64 | 0.25 | 0.21 | 0.66 | 1.37 | 2.51 | 3.46 | 3.82 |
| 80 | 2.35 | 2.54 | 2.29 | 2.06 | 1.48 | 1.15 | 0.78 | 0.25 | 0.32 | 0.92 | 1.45 | 1.56 | 0.71 | 0.20 | 1.42 | 2.34 | 2.35 |
| 82.5 | 1.06 | 0.61 | 1.18 | 0.72 | 0.07 | 0.34 | 0.83 | 0.97 | 1.92 | 2.66 | 2.95 | 3.14 | 2.57 | 1.77 | 0.47 | 0.74 | 1.06 |
| 85 | 0.70 | 0.51 | 0.69 | 0.57 | 1.49 | 1.83 | 1.79 | 2.49 | 3.45 | 3.91 | 4.52 | 4.91 | 4.00 | 3.25 | 1.98 | 0.56 | 0.70 |
| 87.5 | 2.05 | 2.09 | 1.92 | 1.98 | 3.10 | 3.14 | 3.58 | 4.25 | 5.29 | 5.53 | 6.15 | 6.61 | 5.79 | 5.15 | 4.17 | 2.21 | 2.05 |
| 90 | 3.70 | 3.62 | 3.50 | 3.73 | 4.52 | 4.80 | 4.95 | 6.14 | 6.33 | 7.21 | 7.84 | 8.06 | 7.59 | 6.63 | 5.75 | 4.05 | 3.70 |
| 92.5 | 5.64 | 5.32 | 5.08 | 5.43 | 6.31 | 6.47 | 6.68 | 7.72 | 8.36 | 9.07 | 9.91 | 9.83 | 9.27 | 8.23 | 7.27 | 5.47 | 5.64 |
| 95 | 7.22 | 7.08 | 6.55 | 7.07 | 7.79 | 8.32 | 8.41 | 9.43 | 10.38 | 10.82 | 11.42 | 12.10 | 10.94 | 10.08 | 9.22 | 7.72 | 7.22 |
| 97.5 | 9.04 | 8.78 | 8.71 | 8.65 | 9.58 | 9.80 | 10.09 | 11.43 | 12.28 | 12.56 | 13.30 | 13.68 | 12.80 | 12.35 | 11.16 | 9.14 | 9.04 |
| 100 | 11.39 | 10.77 | 10.35 | 10.64 | 11.54 | 11.71 | 12.12 | 13.63 | 13.88 | 14.80 | 15.25 | 15.89 | 14.60 | 13.89 | 13.35 | 11.15 | 11.39 |
| 102.5 | 13.15 | 12.83 | 12.57 | 12.34 | 13.50 | 13.79 | 13.91 | 15.39 | 15.90 | 16.54 | 16.94 | 17.53 | 16.90 | 16.29 | 15.29 | 13.34 | 13.15 |

TABLE 1-1-continued

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 105 | 15.62 | 15.00 | 14.56 | 14.45 | 15.88 | 15.82 | 15.76 | 17.52 | 17.86 | 18.53 | 19.39 | 19.80 | 18.88 | 18.39 | 17.72 | 15.64 | 15.62 |
| 107.5 | 17.67 | 16.99 | 16.85 | 16.79 | 17.84 | 17.78 | 17.91 | 19.53 | 19.89 | 20.59 | 21.14 | 21.69 | 20.80 | 20.54 | 20.15 | 17.71 | 17.67 |
| 110 | 19.55 | 19.57 | 18.89 | 18.61 | 19.98 | 19.81 | 20.00 | 21.72 | 21.91 | 22.70 | 23.34 | 23.65 | 22.79 | 22.82 | 22.34 | 19.96 | 19.55 |
| 112.5 | 22.31 | 21.69 | 21.59 | 21.07 | 22.42 | 22.01 | 21.85 | 24.03 | 24.06 | 24.94 | 25.16 | 26.04 | 25.33 | 25.03 | 24.89 | 22.56 | 22.31 |
| 115 | 24.43 | 24.03 | 23.69 | 23.17 | 24.44 | 24.21 | 24.30 | 26.10 | 26.33 | 27.25 | 27.10 | 28.32 | 27.13 | 27.43 | 27.08 | 24.81 | 24.43 |
| 117.5 | 27.01 | 26.32 | 25.97 | 25.22 | 26.94 | 26.59 | 26.56 | 28.48 | 28.72 | 29.42 | 29.61 | 30.84 | 29.67 | 29.34 | 29.82 | 27.30 | 27.01 |
| 120 | 29.83 | 28.78 | 28.43 | 27.74 | 29.02 | 28.86 | 28.77 | 30.67 | 31.05 | 31.35 | 31.81 | 32.86 | 31.78 | 32.05 | 31.94 | 29.66 | 29.83 |
| 122.5 | 32.35 | 31.48 | 30.95 | 30.44 | 31.63 | 31.30 | 31.28 | 33.10 | 33.32 | 33.91 | 34.07 | 35.19 | 34.32 | 34.82 | 34.62 | 32.15 | 32.35 |
| 125 | 35.00 | 33.89 | 33.82 | 32.95 | 34.31 | 33.86 | 33.55 | 35.30 | 35.71 | 36.02 | 36.14 | 37.53 | 36.62 | 36.97 | 37.05 | 34.69 | 35.00 |
| 127.5 | 37.23 | 36.64 | 35.86 | 35.41 | 37.10 | 36.18 | 35.88 | 37.61 | 38.29 | 38.39 | 39.21 | 39.93 | 38.97 | 39.31 | 39.66 | 37.35 | 37.23 |
| 130 | 39.81 | 39.05 | 38.91 | 38.11 | 39.42 | 38.80 | 38.33 | 40.10 | 40.32 | 41.12 | 41.16 | 42.20 | 41.27 | 41.96 | 42.21 | 39.78 | 39.81 |
| 132.5 | 42.45 | 41.98 | 41.01 | 40.33 | 41.98 | 41.18 | 40.95 | 42.78 | 42.59 | 42.93 | 43.92 | 44.66 | 43.75 | 44.54 | 45.07 | 42.44 | 42.45 |
| 135 | 45.10 | 44.56 | 43.71 | 43.20 | 44.65 | 43.86 | 42.98 | 45.34 | 45.35 | 45.61 | 46.17 | 47.12 | 46.29 | 46.88 | 47.01 | 45.64 | 45.10 |

TABLE 1-2

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 0 | 3.20 | 3.20 | 3.45 | 3.26 | 3.20 | 3.26 | 3.38 | 3.26 | 3.51 | 3.20 | 3.38 | 3.26 | 3.01 | 3.26 | 3.38 | 3.26 | 3.20 |
| 2.5 | 3.82 | 2.07 | 1.18 | 2.30 | 4.03 | 4.66 | 5.26 | 5.71 | 5.07 | 3.18 | 3.21 | 4.84 | 6.99 | 8.61 | 8.31 | 5.89 | 3.82 |
| 5 | 3.82 | 2.49 | 1.61 | 2.30 | 3.91 | 5.10 | 5.39 | 5.59 | 5.13 | 3.06 | 3.15 | 5.28 | 7.24 | 8.48 | 8.18 | 6.27 | 3.82 |
| 7.5 | 3.76 | 2.62 | 1.79 | 2.60 | 3.91 | 4.97 | 5.33 | 5.71 | 5.01 | 3.49 | 3.27 | 5.09 | 7.31 | 8.61 | 8.25 | 6.08 | 3.76 |
| 10 | 3.88 | 3.23 | 2.03 | 3.16 | 4.22 | 5.29 | 5.39 | 6.09 | 5.20 | 3.37 | 3.64 | 4.97 | 7.18 | 8.81 | 8.70 | 6.15 | 3.88 |
| 12.5 | 4.38 | 3.48 | 2.64 | 3.46 | 4.84 | 5.29 | 5.64 | 5.71 | 5.13 | 3.24 | 3.64 | 5.09 | 7.31 | 8.68 | 8.90 | 6.59 | 4.38 |
| 15 | 4.75 | 4.15 | 3.25 | 4.26 | 5.28 | 5.54 | 5.77 | 6.22 | 5.45 | 3.49 | 3.52 | 5.09 | 7.24 | 9.14 | 8.77 | 6.78 | 4.75 |
| 17.5 | 4.87 | 4.46 | 3.73 | 4.44 | 5.59 | 6.35 | 6.21 | 6.60 | 6.01 | 3.99 | 3.83 | 5.41 | 7.82 | 9.20 | 9.29 | 7.04 | 4.87 |
| 20 | 5.18 | 4.82 | 4.40 | 5.30 | 6.09 | 6.23 | 6.65 | 6.73 | 6.01 | 4.17 | 4.01 | 5.91 | 7.89 | 9.14 | 9.35 | 7.55 | 5.18 |
| 22.5 | 5.80 | 5.38 | 4.77 | 5.49 | 6.40 | 6.73 | 6.91 | 7.04 | 6.64 | 4.30 | 4.57 | 6.10 | 8.21 | 9.53 | 9.48 | 7.74 | 5.80 |
| 25 | 5.99 | 6.11 | 5.56 | 6.10 | 6.96 | 6.98 | 6.97 | 7.55 | 6.89 | 4.67 | 4.95 | 6.36 | 8.40 | 9.79 | 9.87 | 7.99 | 5.99 |
| 27.5 | 6.67 | 6.60 | 6.17 | 6.71 | 7.40 | 7.49 | 7.09 | 7.99 | 7.33 | 5.10 | 5.19 | 6.74 | 8.73 | 9.85 | 10.33 | 8.05 | 6.67 |
| 30 | 7.29 | 7.52 | 6.96 | 7.39 | 7.71 | 8.12 | 7.54 | 8.06 | 7.78 | 5.60 | 5.63 | 7.05 | 8.86 | 10.25 | 10.33 | 8.82 | 7.29 |
| 32.5 | 7.97 | 8.13 | 7.56 | 8.00 | 8.58 | 8.74 | 8.04 | 8.75 | 8.34 | 5.97 | 6.37 | 7.43 | 9.31 | 10.77 | 10.72 | 9.20 | 7.97 |
| 35 | 8.47 | 8.69 | 8.60 | 9.04 | 9.20 | 9.18 | 8.61 | 8.94 | 8.72 | 6.90 | 6.69 | 7.87 | 9.82 | 10.83 | 11.24 | 9.71 | 8.47 |
| 37.5 | 9.15 | 9.61 | 9.08 | 9.47 | 9.64 | 9.63 | 9.05 | 9.58 | 9.41 | 7.52 | 7.55 | 8.25 | 10.27 | 11.29 | 11.57 | 10.09 | 9.15 |
| 40 | 9.77 | 10.34 | 9.63 | 10.15 | 10.26 | 10.07 | 9.37 | 9.96 | 9.47 | 7.77 | 7.74 | 8.95 | 9.95 | 11.62 | 11.76 | 10.47 | 9.77 |
| 42.5 | 10.27 | 10.77 | 10.18 | 10.58 | 10.57 | 10.25 | 9.75 | 10.15 | 10.23 | 8.45 | 8.18 | 9.14 | 10.73 | 11.81 | 12.02 | 10.98 | 10.27 |
| 45 | 10.70 | 11.26 | 10.91 | 10.88 | 11.26 | 10.63 | 10.19 | 10.65 | 10.48 | 8.82 | 8.98 | 9.77 | 10.92 | 11.88 | 12.15 | 11.30 | 10.70 |
| 47.5 | 11.14 | 11.81 | 11.57 | 11.44 | 11.38 | 10.76 | 10.38 | 11.03 | 10.92 | 9.32 | 9.36 | 10.02 | 10.86 | 11.94 | 12.22 | 11.42 | 11.14 |
| 50 | 11.26 | 12.43 | 12.00 | 11.56 | 11.57 | 11.01 | 10.63 | 11.03 | 10.80 | 9.63 | 9.73 | 10.34 | 11.11 | 12.01 | 12.54 | 11.87 | 11.26 |
| 52.5 | 11.57 | 12.43 | 12.00 | 12.05 | 11.82 | 11.13 | 11.07 | 11.10 | 11.30 | 10.00 | 10.10 | 10.59 | 11.31 | 11.94 | 12.28 | 11.62 | 11.57 |
| 55 | 12.00 | 12.79 | 12.36 | 12.11 | 11.75 | 11.13 | 10.69 | 11.35 | 11.49 | 10.00 | 10.22 | 10.71 | 11.31 | 11.75 | 12.41 | 11.55 | 12.00 |
| 57.5 | 12.19 | 12.67 | 12.42 | 12.29 | 11.75 | 11.51 | 11.07 | 11.03 | 11.05 | 10.50 | 10.22 | 10.78 | 11.05 | 11.55 | 11.83 | 11.68 | 12.19 |
| 60 | 12.19 | 12.43 | 12.49 | 12.23 | 11.75 | 10.95 | 10.75 | 10.97 | 11.05 | 10.43 | 10.72 | 10.65 | 11.11 | 11.16 | 11.76 | 11.55 | 12.19 |
| 62.5 | 11.88 | 12.43 | 12.49 | 12.11 | 11.57 | 10.76 | 10.57 | 10.84 | 10.98 | 10.43 | 10.41 | 10.53 | 10.73 | 10.70 | 11.44 | 11.42 | 11.88 |
| 65 | 11.69 | 11.93 | 12.24 | 11.87 | 11.32 | 10.82 | 10.38 | 10.34 | 10.67 | 10.56 | 10.47 | 10.21 | 10.47 | 10.18 | 10.91 | 10.98 | 11.69 |
| 67.5 | 11.32 | 11.57 | 11.63 | 11.31 | 10.76 | 9.88 | 9.87 | 10.02 | 10.17 | 10.00 | 10.10 | 9.83 | 9.44 | 9.72 | 10.26 | 10.60 | 11.32 |
| 70 | 10.89 | 11.20 | 11.57 | 10.76 | 10.51 | 9.88 | 9.43 | 9.64 | 9.66 | 9.69 | 9.79 | 9.58 | 9.18 | 9.07 | 9.55 | 9.90 | 10.89 |
| 72.5 | 10.14 | 10.52 | 10.91 | 9.96 | 9.76 | 9.18 | 8.80 | 8.82 | 9.10 | 9.26 | 9.29 | 9.07 | 8.53 | 8.35 | 8.77 | 9.14 | 10.14 |
| 75 | 9.52 | 9.79 | 9.99 | 9.54 | 8.70 | 8.43 | 8.10 | 7.99 | 8.34 | 8.64 | 8.61 | 8.38 | 7.70 | 7.57 | 7.92 | 8.24 | 9.52 |
| 77.5 | 8.59 | 8.87 | 9.26 | 8.68 | 8.08 | 7.49 | 7.16 | 7.04 | 7.59 | 7.95 | 7.87 | 7.62 | 6.79 | 6.52 | 6.88 | 7.48 | 8.59 |
| 80 | 7.85 | 7.89 | 8.23 | 7.51 | 6.84 | 6.61 | 6.21 | 5.84 | 6.58 | 7.15 | 6.87 | 6.48 | 5.83 | 5.48 | 5.71 | 6.27 | 7.85 |
| 82.5 | 6.67 | 6.54 | 7.02 | 6.59 | 6.09 | 5.41 | 5.39 | 5.08 | 5.57 | 6.53 | 6.06 | 5.47 | 4.73 | 4.37 | 4.60 | 5.26 | 6.67 |
| 85 | 5.31 | 5.50 | 6.10 | 5.61 | 4.59 | 4.53 | 4.25 | 3.75 | 4.31 | 5.10 | 5.44 | 4.59 | 3.44 | 2.87 | 2.91 | 4.30 | 5.31 |
| 87.5 | 4.07 | 4.46 | 4.65 | 4.38 | 3.54 | 3.21 | 2.99 | 2.42 | 3.31 | 4.23 | 4.14 | 3.26 | 2.34 | 1.76 | 1.03 | 2.71 | 4.07 |
| 90 | 2.64 | 3.05 | 3.19 | 2.85 | 2.04 | 1.51 | 1.54 | 1.22 | 1.67 | 2.87 | 2.96 | 1.68 | 0.79 | 0.06 | 0.21 | 1.50 | 2.64 |
| 92.5 | 1.15 | 1.27 | 2.15 | 1.19 | 0.73 | 0.38 | 0.04 | 0.11 | 0.29 | 1.75 | 1.78 | 1.05 | 0.69 | 1.57 | 1.71 | 0.09 | 1.15 |
| 95 | 0.65 | 0.33 | 0.27 | 0.28 | 1.13 | 1.32 | 1.36 | 1.57 | 1.28 | 0.08 | 0.29 | 0.78 | 2.04 | 3.33 | 3.01 | 1.68 | 0.65 |
| 97.5 | 2.14 | 1.98 | 1.55 | 1.87 | 2.75 | 2.95 | 2.69 | 3.15 | 2.61 | 1.16 | 1.33 | 2.23 | 3.59 | 4.77 | 5.02 | 3.27 | 2.14 |
| 100 | 4.06 | 3.82 | 3.25 | 3.83 | 4.18 | 4.78 | 4.45 | 4.60 | 4.56 | 2.46 | 3.13 | 3.68 | 5.59 | 6.59 | 6.65 | 4.98 | 4.06 |
| 102.5 | 5.86 | 5.66 | 4.96 | 5.86 | 6.24 | 6.41 | 6.10 | 6.57 | 6.07 | 4.32 | 4.55 | 5.64 | 7.59 | 8.62 | 8.47 | 7.21 | 5.86 |
| 105 | 7.72 | 7.68 | 7.14 | 7.45 | 7.92 | 7.92 | 7.80 | 8.47 | 7.83 | 6.06 | 6.48 | 7.22 | 9.07 | 10.58 | 10.68 | 8.80 | 7.72 |
| 107.5 | 9.89 | 9.77 | 9.09 | 9.48 | 10.22 | 10.06 | 10.07 | 10.17 | 9.90 | 8.04 | 8.28 | 9.37 | 11.33 | 12.14 | 12.57 | 11.03 | 9.89 |
| 110 | 11.81 | 11.91 | 11.21 | 11.56 | 11.97 | 12.14 | 11.40 | 11.95 | 11.85 | 9.97 | 9.96 | 11.20 | 13.20 | 14.30 | 14.91 | 13.06 | 11.81 |
| 112.5 | 14.17 | 14.36 | 13.52 | 13.71 | 14.46 | 14.02 | 13.79 | 14.23 | 13.87 | 11.83 | 12.01 | 13.41 | 15.07 | 16.84 | 16.86 | 15.03 | 14.17 |
| 115 | 16.28 | 16.45 | 15.95 | 16.04 | 16.57 | 16.16 | 15.75 | 16.44 | 16.20 | 13.93 | 13.43 | 15.50 | 17.39 | 18.80 | 19.33 | 17.64 | 16.28 |
| 117.5 | 18.69 | 18.84 | 18.26 | 18.55 | 18.81 | 18.61 | 18.21 | 18.53 | 18.33 | 16.04 | 15.98 | 17.77 | 19.39 | 20.95 | 21.35 | 19.74 | 18.69 |
| 120 | 21.05 | 21.23 | 20.94 | 20.70 | 21.12 | 20.63 | 20.29 | 21.06 | 20.79 | 18.21 | 17.97 | 19.92 | 21.78 | 23.63 | 23.95 | 22.28 | 21.05 |
| 122.5 | 23.47 | 23.56 | 23.07 | 23.52 | 23.42 | 23.02 | 22.76 | 23.09 | 22.68 | 20.32 | 20.02 | 22.06 | 24.36 | 25.59 | 26.30 | 24.38 | 23.47 |
| 125 | 26.01 | 26.32 | 25.80 | 25.85 | 25.91 | 25.60 | 25.09 | 25.62 | 25.00 | 22.86 | 23.00 | 24.53 | 26.29 | 28.46 | 28.77 | 27.12 | 26.01 |
| 127.5 | 28.68 | 28.89 | 28.35 | 28.55 | 28.46 | 28.05 | 27.17 | 28.15 | 28.15 | 24.97 | 25.30 | 26.93 | 28.93 | 30.68 | 31.43 | 29.34 | 28.68 |
| 130 | 31.41 | 31.34 | 30.90 | 30.64 | 31.08 | 30.63 | 29.76 | 30.37 | 30.60 | 27.51 | 27.66 | 29.01 | 31.38 | 33.36 | 33.84 | 32.01 | 31.41 |

TABLE 1-2-continued

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 132.5 | 33.64 | 34.22 | 33.82 | 33.52 | 33.57 | 32.64 | 32.16 | 32.84 | 33.12 | 29.99 | 30.33 | 31.60 | 33.71 | 35.58 | 36.57 | 34.37 | 33.64 |
| 135 | 36.31 | 36.92 | 36.13 | 36.40 | 36.18 | 35.60 | 34.75 | 35.05 | 35.32 | 32.66 | 32.69 | 34.51 | 36.61 | 38.19 | 39.05 | 38.06 | 36.31 |

TABLE 1-3

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 0 | 0.60 | 0.66 | 0.53 | 0.27 | 0.93 | 0.86 | 0.79 | 0.86 | 1.32 | 0.66 | 0.53 | 0.27 | 0.93 | 0.86 | 0.79 | 0.86 | 0.60 |
| 2.5 | 1.06 | 0.70 | 1.51 | 3.20 | 2.85 | 2.45 | 0.51 | 0.36 | 0.15 | 2.22 | 4.06 | 5.38 | 5.70 | 4.26 | 1.79 | 0.19 | 1.06 |
| 5 | 0.99 | 0.89 | 0.99 | 2.94 | 3.10 | 2.71 | 0.57 | 0.43 | 0.05 | 1.83 | 3.87 | 5.13 | 5.82 | 3.88 | 1.73 | 0.59 | 0.99 |
| 7.5 | 1.19 | 0.83 | 1.06 | 2.62 | 2.60 | 2.64 | 0.05 | 0.82 | 0.21 | 1.83 | 3.55 | 4.57 | 5.51 | 3.32 | 1.73 | 0.46 | 1.19 |
| 10 | 1.12 | 0.83 | 0.73 | 2.88 | 2.41 | 2.20 | 0.14 | 0.82 | 0.47 | 1.45 | 3.05 | 4.13 | 5.14 | 2.87 | 1.28 | 0.72 | 1.12 |
| 12.5 | 1.19 | 1.42 | 0.54 | 2.18 | 2.21 | 2.20 | 0.66 | 1.21 | 1.06 | 1.25 | 2.61 | 3.33 | 4.65 | 2.12 | 0.96 | 1.44 | 1.19 |
| 15 | 1.72 | 1.75 | 0.18 | 1.99 | 2.02 | 1.30 | 0.99 | 1.54 | 1.64 | 0.74 | 2.42 | 2.77 | 3.85 | 1.55 | 0.51 | 1.05 | 1.72 |
| 17.5 | 1.92 | 2.35 | 0.57 | 1.29 | 0.88 | 0.92 | 1.83 | 2.07 | 2.17 | 0.04 | 1.54 | 2.58 | 3.60 | 1.30 | 0.20 | 1.90 | 1.92 |
| 20 | 2.58 | 2.35 | 1.02 | 0.65 | 0.31 | 0.09 | 2.09 | 2.59 | 2.69 | 0.73 | 0.79 | 1.34 | 2.55 | 0.48 | 0.58 | 2.69 | 2.58 |
| 22.5 | 3.23 | 3.34 | 1.67 | 0.18 | 0.90 | 0.10 | 3.20 | 3.64 | 3.53 | 1.31 | 0.10 | 0.66 | 1.44 | 0.52 | 1.35 | 2.89 | 3.23 |
| 25 | 3.96 | 3.74 | 2.91 | 0.69 | 1.41 | 1.25 | 3.40 | 3.97 | 3.92 | 2.21 | 0.53 | 0.33 | 0.45 | 1.78 | 2.19 | 3.80 | 3.96 |
| 27.5 | 4.69 | 4.80 | 3.16 | 1.58 | 2.36 | 2.08 | 4.44 | 4.42 | 5.03 | 2.97 | 1.73 | 1.64 | 0.53 | 2.66 | 2.70 | 4.20 | 4.69 |
| 30 | 5.21 | 5.66 | 4.33 | 2.60 | 3.12 | 2.72 | 5.35 | 5.67 | 5.42 | 4.13 | 2.80 | 2.44 | 1.40 | 3.36 | 3.47 | 4.92 | 5.21 |
| 32.5 | 5.74 | 6.39 | 4.66 | 3.88 | 4.39 | 3.74 | 6.19 | 6.32 | 6.86 | 4.64 | 4.05 | 3.75 | 2.57 | 4.49 | 4.30 | 5.91 | 5.74 |
| 35 | 6.40 | 7.18 | 5.57 | 4.32 | 5.03 | 4.88 | 7.04 | 7.18 | 7.44 | 5.79 | 4.62 | 4.74 | 3.43 | 5.75 | 5.33 | 6.82 | 6.40 |
| 37.5 | 7.19 | 7.91 | 6.61 | 5.41 | 6.36 | 5.52 | 7.89 | 7.96 | 8.49 | 6.82 | 5.88 | 6.10 | 4.85 | 6.19 | 6.04 | 7.94 | 7.19 |
| 40 | 8.31 | 8.63 | 7.71 | 6.68 | 7.57 | 6.54 | 8.86 | 8.95 | 9.40 | 7.65 | 7.26 | 7.10 | 5.97 | 7.26 | 7.00 | 8.33 | 8.31 |
| 42.5 | 9.17 | 9.36 | 8.68 | 7.38 | 8.14 | 7.56 | 9.64 | 9.60 | 9.66 | 8.55 | 7.64 | 8.09 | 6.83 | 9.02 | 8.34 | 9.32 | 9.17 |
| 45 | 9.70 | 9.96 | 9.59 | 8.78 | 9.29 | 8.46 | 10.23 | 10.06 | 10.51 | 9.38 | 9.15 | 8.90 | 8.00 | 9.90 | 8.60 | 9.65 | 9.70 |
| 47.5 | 9.77 | 10.49 | 10.50 | 8.97 | 9.92 | 9.61 | 10.81 | 10.65 | 10.96 | 10.22 | 9.84 | 10.26 | 8.99 | 10.53 | 9.50 | 10.50 | 9.77 |
| 50 | 10.75 | 11.21 | 11.15 | 10.18 | 10.68 | 10.12 | 11.33 | 11.76 | 11.29 | 10.60 | 10.72 | 10.94 | 9.91 | 11.29 | 10.53 | 10.90 | 10.75 |
| 52.5 | 11.35 | 11.55 | 11.54 | 10.89 | 11.64 | 11.01 | 11.98 | 12.02 | 12.07 | 11.24 | 11.16 | 11.81 | 10.53 | 12.11 | 10.78 | 11.49 | 11.35 |
| 55 | 11.41 | 12.21 | 12.06 | 11.71 | 12.15 | 11.26 | 12.18 | 12.29 | 12.33 | 11.95 | 12.04 | 12.12 | 11.33 | 12.67 | 11.42 | 11.62 | 11.41 |
| 57.5 | 12.01 | 11.94 | 12.38 | 12.16 | 12.21 | 11.58 | 12.64 | 12.22 | 12.72 | 12.07 | 12.16 | 12.99 | 11.95 | 12.67 | 11.42 | 12.21 | 12.01 |
| 60 | 12.01 | 12.27 | 12.38 | 12.54 | 12.91 | 12.09 | 12.90 | 12.35 | 12.59 | 12.65 | 12.48 | 13.18 | 12.51 | 13.24 | 12.32 | 12.08 | 12.01 |
| 62.5 | 12.01 | 11.94 | 12.58 | 12.42 | 13.23 | 12.48 | 12.83 | 12.09 | 12.79 | 12.39 | 13.11 | 13.30 | 12.94 | 13.37 | 12.51 | 12.41 | 12.01 |
| 65 | 11.81 | 12.21 | 12.97 | 12.86 | 13.23 | 12.35 | 12.70 | 12.35 | 12.26 | 12.65 | 12.73 | 13.24 | 13.00 | 13.49 | 12.45 | 12.21 | 11.81 |
| 67.5 | 12.01 | 12.34 | 12.38 | 12.54 | 13.29 | 12.60 | 12.24 | 12.29 | 12.20 | 12.33 | 12.73 | 13.30 | 13.19 | 13.05 | 12.39 | 11.95 | 12.01 |
| 70 | 11.35 | 11.74 | 11.99 | 12.54 | 12.91 | 12.35 | 12.18 | 11.76 | 11.87 | 12.33 | 12.67 | 12.93 | 13.00 | 12.99 | 11.94 | 11.55 | 11.35 |
| 72.5 | 11.08 | 11.41 | 11.99 | 12.54 | 12.15 | 11.84 | 11.33 | 11.24 | 11.22 | 11.69 | 12.04 | 12.93 | 12.88 | 12.48 | 11.68 | 11.09 | 11.08 |
| 75 | 10.36 | 11.02 | 11.15 | 11.78 | 12.02 | 11.33 | 10.88 | 10.71 | 10.57 | 11.24 | 11.72 | 12.31 | 12.57 | 12.48 | 11.17 | 10.90 | 10.36 |
| 77.5 | 9.50 | 10.02 | 10.50 | 11.40 | 11.13 | 11.01 | 9.64 | 9.67 | 9.92 | 10.66 | 11.35 | 11.63 | 11.83 | 11.29 | 10.65 | 9.98 | 9.50 |
| 80 | 8.91 | 9.03 | 9.59 | 10.57 | 10.24 | 10.18 | 8.80 | 8.75 | 8.75 | 9.89 | 10.34 | 10.94 | 11.40 | 10.66 | 9.82 | 9.45 | 8.91 |
| 82.5 | 7.79 | 7.58 | 8.62 | 9.93 | 9.60 | 9.10 | 8.15 | 7.64 | 7.83 | 9.00 | 9.77 | 10.20 | 10.59 | 9.78 | 8.79 | 8.07 | 7.79 |
| 85 | 7.13 | 6.78 | 7.77 | 8.34 | 8.71 | 8.46 | 7.10 | 6.52 | 6.34 | 7.65 | 8.77 | 9.08 | 9.61 | 8.90 | 8.09 | 7.02 | 7.13 |
| 87.5 | 5.41 | 5.52 | 6.15 | 7.32 | 7.19 | 7.12 | 5.41 | 5.28 | 5.36 | 6.69 | 7.39 | 7.72 | 8.56 | 7.39 | 6.74 | 5.64 | 5.41 |
| 90 | 4.42 | 4.07 | 5.05 | 6.42 | 5.98 | 5.78 | 4.63 | 3.84 | 3.73 | 5.22 | 6.38 | 6.97 | 7.26 | 6.00 | 5.52 | 4.33 | 4.42 |
| 92.5 | 2.38 | 2.42 | 3.88 | 4.77 | 4.46 | 4.82 | 2.87 | 2.53 | 2.56 | 3.94 | 4.62 | 5.11 | 6.03 | 4.43 | 4.05 | 2.82 | 2.38 |
| 95 | 1.06 | 1.03 | 2.26 | 3.68 | 2.80 | 3.10 | 1.31 | 0.76 | 1.19 | 2.53 | 3.68 | 3.68 | 4.61 | 2.79 | 2.51 | 1.24 | 1.06 |
| 97.5 | 0.33 | 0.63 | 0.44 | 1.84 | 1.47 | 1.38 | 0.51 | 0.82 | 0.83 | 0.54 | 2.17 | 2.13 | 3.00 | 1.53 | 0.97 | 0.07 | 0.33 |
| 100 | 1.91 | 2.55 | 0.73 | 0.01 | 0.44 | 0.04 | 2.20 | 2.65 | 2.40 | 0.93 | 0.22 | 0.52 | 1.58 | 0.08 | 0.70 | 1.91 | 1.91 |
| 102.5 | 3.63 | 4.07 | 2.74 | 1.73 | 1.90 | 1.81 | 4.09 | 4.09 | 4.09 | 2.98 | 1.98 | 1.40 | 0.45 | 2.62 | 2.43 | 4.07 | 3.63 |
| 105 | 5.87 | 6.38 | 5.15 | 3.52 | 4.18 | 3.54 | 6.17 | 6.19 | 6.11 | 4.33 | 3.55 | 3.70 | 1.93 | 4.01 | 4.10 | 5.91 | 5.87 |
| 107.5 | 7.91 | 8.10 | 6.70 | 5.87 | 5.90 | 5.58 | 8.12 | 8.09 | 8.00 | 6.77 | 5.69 | 5.44 | 3.97 | 6.40 | 6.15 | 8.08 | 7.91 |
| 110 | 9.96 | 10.22 | 9.11 | 7.60 | 8.12 | 7.94 | 9.75 | 10.32 | 10.15 | 8.94 | 7.51 | 7.49 | 6.50 | 8.73 | 8.59 | 9.92 | 9.96 |
| 112.5 | 12.46 | 12.21 | 11.64 | 9.95 | 10.35 | 10.17 | 12.42 | 12.67 | 12.36 | 10.80 | 9.65 | 9.59 | 8.29 | 10.68 | 10.58 | 12.15 | 12.46 |
| 115 | 13.98 | 14.98 | 13.78 | 12.12 | 13.08 | 12.28 | 14.69 | 14.51 | 14.84 | 13.05 | 12.04 | 11.89 | 10.76 | 13.39 | 13.02 | 14.58 | 13.98 |
| 117.5 | 16.55 | 17.37 | 15.92 | 14.35 | 15.24 | 14.06 | 16.78 | 17.00 | 17.12 | 15.10 | 14.37 | 14.06 | 13.23 | 15.09 | 15.26 | 16.35 | 16.55 |
| 120 | 19.33 | 19.42 | 18.65 | 16.45 | 17.65 | 16.93 | 19.51 | 19.03 | 19.86 | 17.79 | 17.07 | 16.98 | 15.57 | 17.98 | 17.38 | 19.31 | 19.33 |
| 122.5 | 21.50 | 22.00 | 20.86 | 19.19 | 20.26 | 19.55 | 21.66 | 21.65 | 22.33 | 20.22 | 19.46 | 18.72 | 17.92 | 20.37 | 19.62 | 21.67 | 21.50 |
| 125 | 23.81 | 24.38 | 23.45 | 21.87 | 22.42 | 21.72 | 24.13 | 24.40 | 24.81 | 22.66 | 22.04 | 21.76 | 20.14 | 23.14 | 22.89 | 23.90 | 23.81 |
| 127.5 | 26.25 | 26.89 | 25.86 | 24.23 | 25.28 | 24.59 | 26.73 | 26.63 | 27.22 | 24.90 | 24.36 | 24.36 | 23.16 | 25.66 | 24.88 | 26.79 | 26.25 |
| 130 | 29.09 | 29.67 | 28.52 | 27.10 | 28.01 | 26.50 | 29.14 | 29.71 | 29.96 | 27.72 | 26.63 | 27.15 | 25.45 | 28.37 | 27.32 | 29.29 | 29.09 |
| 132.5 | 31.53 | 32.12 | 31.12 | 29.52 | 30.74 | 29.18 | 31.61 | 31.67 | 32.24 | 30.54 | 29.21 | 29.88 | 28.23 | 30.70 | 29.82 | 31.58 | 31.53 |
| 135 | 34.37 | 34.83 | 33.91 | 32.51 | 33.73 | 31.61 | 34.67 | 35.08 | 34.91 | 33.36 | 31.97 | 32.37 | 30.94 | 33.47 | 32.65 | 35.06 | 34.37 |

TABLE 1-4

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 0 | 4.00 | 3.71 | 3.62 | 3.23 | 3.04 | 3.23 | 2.65 | 3.42 | 3.13 | 3.71 | 3.62 | 3.23 | 3.04 | 3.23 | 2.65 | 3.42 | 4.00 |
| 2.5 | 3.71 | 2.51 | 2.70 | 2.56 | 2.69 | 3.58 | 3.04 | 3.19 | 2.45 | 2.03 | 1.09 | 0.48 | 0.08 | 0.45 | 1.84 | 2.33 | 3.71 |
| 5 | 3.04 | 2.90 | 3.18 | 2.17 | 2.69 | 3.29 | 2.56 | 2.80 | 2.06 | 2.42 | 0.79 | 0.12 | 0.02 | 0.95 | 1.35 | 2.23 | 3.04 |
| 7.5 | 3.52 | 3.00 | 2.89 | 1.69 | 2.30 | 2.72 | 2.37 | 2.51 | 2.25 | 2.32 | 0.89 | 0.02 | 0.22 | 0.25 | 1.94 | 2.43 | 3.52 |
| 10 | 3.04 | 2.61 | 2.60 | 2.56 | 1.82 | 2.81 | 2.37 | 2.03 | 2.15 | 1.93 | 0.59 | 0.62 | 0.52 | 0.45 | 1.94 | 2.62 | 3.04 |
| 12.5 | 3.04 | 2.90 | 2.21 | 1.40 | 1.53 | 2.91 | 1.99 | 2.13 | 1.57 | 1.74 | 0.99 | 0.62 | 0.62 | 0.65 | 2.14 | 2.23 | 3.04 |
| 15 | 3.13 | 2.41 | 1.44 | 1.59 | 1.04 | 2.04 | 1.79 | 1.26 | 1.77 | 1.83 | 0.79 | 0.22 | 0.32 | 1.25 | 1.84 | 2.33 | 3.13 |
| 17.5 | 2.75 | 2.22 | 1.83 | 1.11 | 1.24 | 1.76 | 1.02 | 1.06 | 0.89 | 1.25 | 0.40 | 0.12 | 0.22 | 0.65 | 2.14 | 2.14 | 2.75 |
| 20 | 3.04 | 2.03 | 1.92 | 0.14 | 0.46 | 0.89 | 0.44 | 0.68 | 0.70 | 1.15 | 0.20 | 0.32 | 0.92 | 0.65 | 1.55 | 2.04 | 3.04 |
| 22.5 | 2.07 | 1.44 | 1.25 | 0.04 | 0.12 | 0.60 | 0.13 | 0.38 | 0.22 | 0.56 | 0.20 | 0.22 | 0.32 | 0.55 | 1.45 | 1.75 | 2.07 |
| 25 | 2.07 | 0.57 | 0.96 | 0.83 | 1.28 | 0.74 | 1.58 | 0.67 | 0.95 | 0.56 | 0.70 | 0.22 | 0.02 | 0.05 | 1.84 | 1.45 | 2.07 |
| 27.5 | 0.72 | 0.47 | 0.11 | 1.12 | 1.95 | 1.60 | 1.96 | 1.54 | 1.43 | 0.31 | 0.89 | 0.58 | 0.28 | 0.45 | 1.25 | 1.26 | 0.72 |
| 30 | 1.01 | 0.69 | 1.37 | 1.71 | 3.30 | 2.28 | 3.31 | 2.70 | 2.40 | 0.80 | 1.79 | 0.68 | 0.68 | 0.45 | 1.05 | 1.06 | 1.01 |
| 32.5 | 0.14 | 1.47 | 1.37 | 2.87 | 3.21 | 3.53 | 4.37 | 3.76 | 3.66 | 1.78 | 2.58 | 1.48 | 1.78 | 1.54 | 0.17 | 0.21 | 0.14 |
| 35 | 1.12 | 2.05 | 3.02 | 4.42 | 4.75 | 4.29 | 5.43 | 4.92 | 4.44 | 2.66 | 3.28 | 2.18 | 1.58 | 1.94 | 0.72 | 0.89 | 1.12 |
| 37.5 | 1.21 | 3.02 | 3.31 | 5.00 | 5.82 | 5.16 | 6.58 | 6.18 | 5.60 | 4.12 | 4.37 | 2.48 | 2.48 | 2.64 | 1.11 | 1.87 | 1.21 |
| 40 | 3.14 | 3.79 | 4.47 | 6.07 | 6.59 | 6.60 | 7.07 | 7.04 | 6.09 | 4.61 | 5.16 | 3.37 | 3.48 | 3.24 | 2.29 | 2.75 | 3.14 |
| 42.5 | 3.53 | 5.54 | 5.34 | 6.94 | 7.85 | 7.27 | 8.89 | 7.62 | 7.35 | 5.78 | 5.95 | 3.97 | 4.58 | 4.43 | 2.98 | 3.43 | 3.53 |
| 45 | 5.07 | 6.02 | 6.60 | 7.52 | 8.43 | 8.90 | 9.28 | 8.78 | 7.83 | 6.96 | 6.85 | 5.47 | 5.48 | 5.43 | 4.06 | 4.41 | 5.07 |
| 47.5 | 5.65 | 7.09 | 7.09 | 8.59 | 9.30 | 8.71 | 9.95 | 9.36 | 8.90 | 7.44 | 7.54 | 6.07 | 5.87 | 6.13 | 4.85 | 5.77 | 5.65 |
| 50 | 6.52 | 7.48 | 8.06 | 9.08 | 10.07 | 9.67 | 10.63 | 10.13 | 9.87 | 8.23 | 8.04 | 6.57 | 7.17 | 6.72 | 5.83 | 6.56 | 6.52 |
| 52.5 | 7.97 | 8.74 | 8.64 | 10.14 | 10.84 | 10.73 | 11.40 | 11.00 | 10.45 | 9.50 | 9.03 | 7.07 | 7.57 | 7.62 | 6.42 | 7.14 | 7.97 |
| 55 | 8.17 | 9.13 | 9.61 | 10.82 | 10.94 | 10.92 | 11.78 | 11.58 | 10.84 | 9.89 | 9.23 | 7.96 | 8.07 | 8.12 | 6.91 | 7.92 | 8.17 |
| 57.5 | 9.52 | 9.42 | 10.19 | 11.31 | 11.52 | 12.26 | 12.65 | 11.48 | 11.32 | 10.18 | 9.62 | 8.46 | 8.47 | 8.92 | 7.90 | 8.51 | 9.52 |
| 60 | 8.94 | 9.81 | 10.38 | 11.21 | 11.52 | 11.40 | 12.36 | 12.16 | 11.42 | 10.77 | 9.72 | 9.56 | 8.37 | 9.02 | 8.09 | 9.00 | 8.94 |
| 62.5 | 10.48 | 10.10 | 10.97 | 11.31 | 11.33 | 12.07 | 12.36 | 12.06 | 12.00 | 10.47 | 10.72 | 9.26 | 9.17 | 8.82 | 8.88 | 9.78 | 10.48 |
| 65 | 10.00 | 10.68 | 10.67 | 11.79 | 11.42 | 11.88 | 11.98 | 12.26 | 11.42 | 10.86 | 10.42 | 9.86 | 9.47 | 9.91 | 9.96 | 9.49 | 10.00 |
| 67.5 | 10.48 | 11.07 | 10.67 | 11.40 | 11.81 | 11.78 | 12.36 | 11.87 | 11.71 | 11.35 | 9.82 | 10.36 | 9.17 | 9.81 | 9.37 | 10.46 | 10.48 |
| 70 | 10.19 | 11.07 | 10.48 | 11.31 | 11.13 | 11.59 | 11.69 | 11.58 | 11.32 | 10.38 | 10.32 | 9.56 | 9.37 | 9.81 | 9.77 | 10.07 | 10.19 |
| 72.5 | 10.00 | 10.58 | 10.09 | 10.82 | 11.04 | 11.30 | 11.88 | 11.19 | 10.74 | 10.86 | 9.72 | 9.46 | 9.07 | 9.31 | 8.88 | 10.07 | 10.00 |
| 75 | 10.39 | 10.10 | 10.29 | 10.43 | 9.88 | 10.73 | 10.24 | 10.52 | 10.16 | 9.69 | 9.53 | 8.66 | 8.47 | 9.41 | 9.27 | 9.68 | 10.39 |
| 77.5 | 9.52 | 9.81 | 9.41 | 9.85 | 9.49 | 9.67 | 9.66 | 9.94 | 9.58 | 9.30 | 9.13 | 8.06 | 8.67 | 8.92 | 9.27 | 8.70 | 9.52 |
| 80 | 9.23 | 9.13 | 8.83 | 8.78 | 8.43 | 9.19 | 9.28 | 9.17 | 9.00 | 8.81 | 8.43 | 7.96 | 7.67 | 8.22 | 8.88 | 9.10 | 9.23 |
| 82.5 | 8.55 | 8.74 | 8.54 | 7.62 | 8.14 | 9.10 | 8.22 | 8.11 | 8.61 | 8.52 | 7.34 | 7.67 | 7.77 | 7.62 | 8.29 | 8.41 | 8.55 |
| 85 | 8.17 | 7.77 | 7.48 | 7.14 | 6.88 | 7.46 | 7.07 | 6.95 | 7.35 | 7.44 | 7.05 | 6.47 | 6.37 | 7.42 | 8.09 | 7.53 | 8.17 |
| 87.5 | 7.59 | 6.99 | 6.60 | 5.68 | 5.72 | 6.21 | 6.01 | 5.79 | 5.99 | 6.08 | 6.05 | 5.47 | 6.07 | 6.23 | 7.01 | 7.53 | 7.59 |
| 90 | 6.33 | 5.83 | 5.83 | 4.62 | 4.66 | 4.87 | 4.27 | 5.40 | 4.92 | 5.49 | 4.66 | 5.07 | 4.98 | 5.43 | 6.52 | 6.07 | 6.33 |
| 92.5 | 5.36 | 4.86 | 4.57 | 3.55 | 3.30 | 3.91 | 3.50 | 3.47 | 3.18 | 4.61 | 3.47 | 4.07 | 4.28 | 3.73 | 6.23 | 4.70 | 5.36 |
| 95 | 4.69 | 3.70 | 2.92 | 2.39 | 2.44 | 2.76 | 2.15 | 2.31 | 2.40 | 3.54 | 2.09 | 3.17 | 2.68 | 3.14 | 3.67 | 4.02 | 4.69 |
| 97.5 | 3.43 | 2.14 | 1.95 | 1.32 | 0.70 | 1.41 | 0.33 | 0.48 | 1.14 | 1.58 | 1.39 | 1.48 | 1.48 | 1.54 | 3.18 | 3.14 | 3.43 |
| 100 | 2.08 | 0.98 | 0.60 | 0.04 | 1.14 | 0.32 | 1.41 | 0.10 | 0.60 | 0.71 | 0.40 | 0.58 | 0.78 | 0.64 | 1.50 | 1.48 | 2.08 |
| 102.5 | 0.83 | 0.28 | 0.86 | 2.56 | 2.69 | 1.85 | 2.66 | 2.51 | 1.96 | 1.15 | 1.68 | 0.52 | 1.52 | 1.15 | 0.23 | 0.11 | 0.83 |
| 105 | 1.11 | 1.74 | 2.02 | 3.53 | 3.85 | 3.87 | 4.39 | 4.15 | 3.32 | 2.91 | 3.27 | 2.31 | 2.02 | 1.95 | 0.66 | 1.06 | 1.11 |
| 107.5 | 2.94 | 3.87 | 3.77 | 5.47 | 5.59 | 5.79 | 6.03 | 5.89 | 6.03 | 3.89 | 4.76 | 4.41 | 3.72 | 4.14 | 2.53 | 2.72 | 2.94 |
| 110 | 3.91 | 5.13 | 5.51 | 6.73 | 7.62 | 7.23 | 8.05 | 7.72 | 7.39 | 6.03 | 6.05 | 5.31 | 5.22 | 5.33 | 4.10 | 4.48 | 3.91 |
| 112.5 | 5.84 | 7.07 | 7.45 | 8.96 | 9.16 | 8.67 | 10.27 | 9.65 | 9.52 | 7.99 | 8.23 | 6.90 | 6.82 | 6.73 | 5.87 | 6.24 | 5.84 |
| 115 | 7.29 | 8.72 | 9.39 | 10.70 | 11.00 | 11.55 | 12.58 | 11.97 | 10.88 | 9.84 | 10.22 | 8.80 | 9.02 | 9.02 | 6.95 | 7.31 | 7.29 |
| 117.5 | 9.03 | 10.85 | 11.23 | 12.84 | 13.41 | 12.99 | 13.73 | 13.52 | 12.72 | 11.70 | 11.70 | 10.79 | 10.92 | 11.41 | 9.12 | 9.36 | 9.03 |
| 120 | 11.83 | 12.31 | 13.17 | 14.78 | 15.06 | 14.63 | 15.95 | 15.54 | 14.66 | 13.75 | 14.09 | 12.39 | 12.92 | 12.61 | 10.89 | 11.12 | 11.83 |
| 122.5 | 13.37 | 14.73 | 15.49 | 17.01 | 17.86 | 17.51 | 18.93 | 17.96 | 17.38 | 15.80 | 15.87 | 14.29 | 14.22 | 14.40 | 12.86 | 13.27 | 13.37 |
| 125 | 15.11 | 16.77 | 16.85 | 19.04 | 19.11 | 19.43 | 20.76 | 19.98 | 19.51 | 17.66 | 18.15 | 17.28 | 16.02 | 16.30 | 15.12 | 15.03 | 15.11 |
| 127.5 | 17.23 | 19.10 | 19.08 | 21.08 | 21.43 | 21.35 | 22.88 | 22.30 | 21.84 | 19.51 | 20.24 | 19.28 | 18.72 | 18.09 | 16.50 | 17.27 | 17.23 |
| 130 | 19.26 | 21.33 | 21.21 | 23.41 | 24.33 | 23.94 | 25.19 | 24.13 | 24.26 | 22.64 | 23.01 | 20.67 | 19.62 | 20.88 | 18.86 | 19.13 | 19.26 |
| 132.5 | 21.77 | 23.37 | 23.15 | 25.44 | 26.27 | 25.67 | 27.02 | 27.03 | 26.40 | 24.50 | 24.50 | 23.27 | 22.82 | 23.17 | 21.61 | 21.18 | 21.77 |
| 135 | 24.19 | 26.18 | 26.06 | 27.96 | 28.59 | 28.84 | 30.00 | 28.86 | 28.82 | 26.94 | 26.98 | 24.86 | 25.02 | 25.36 | 23.77 | 24.40 | 24.19 |

TABLE 1-5

| | c | | | | | | | | | | | | | | | | |
|---|---|---|---|---|---|---|---|---|---|---|---|---|---|---|---|---|---|
| γ | 0 | 22.5 | 45 | 67.5 | 90 | 112.5 | 135 | 157.5 | 180 | 202.5 | 225 | 247.5 | 270 | 292.5 | 315 | 337.5 | 360 |
| 0 | 29.93 | 29.85 | 29.85 | 29.61 | 29.61 | 29.29 | 29.61 | 29.61 | 29.21 | 29.85 | 29.85 | 29.61 | 29.61 | 29.29 | 29.61 | 29.61 | 29.93 |
| 2.5 | 30.26 | 28.53 | 27.92 | 27.42 | 27.56 | 29.83 | 31.53 | 33.88 | 35.57 | 37.32 | 37.75 | 36.69 | 35.88 | 34.21 | 32.70 | 31.38 | 30.26 |
| 5 | 30.34 | 29.36 | 27.92 | 27.59 | 28.31 | 29.50 | 31.45 | 33.05 | 35.14 | 36.75 | 36.40 | 35.97 | 34.50 | 33.83 | 32.01 | 30.67 | 30.34 |
| 7.5 | 29.85 | 28.95 | 28.25 | 28.17 | 28.39 | 29.26 | 31.29 | 32.60 | 33.97 | 35.75 | 35.26 | 34.97 | 33.77 | 33.08 | 31.47 | 30.59 | 29.85 |
| 10 | 29.53 | 28.20 | 28.00 | 27.75 | 28.06 | 28.45 | 30.43 | 31.24 | 32.37 | 34.53 | 34.20 | 33.32 | 32.23 | 31.96 | 30.55 | 30.20 | 29.53 |
| 12.5 | 28.97 | 27.54 | 27.33 | 27.42 | 27.48 | 27.72 | 29.02 | 30.71 | 31.13 | 33.03 | 32.49 | 31.74 | 30.48 | 30.61 | 29.86 | 29.17 | 28.97 |
| 15 | 27.92 | 26.88 | 26.66 | 26.74 | 26.81 | 26.67 | 27.93 | 28.91 | 29.24 | 31.31 | 30.86 | 29.37 | 28.51 | 29.04 | 28.40 | 27.99 | 27.92 |
| 17.5 | 26.95 | 26.31 | 25.82 | 25.90 | 25.90 | 25.46 | 26.44 | 27.10 | 27.35 | 29.52 | 28.66 | 27.58 | 26.62 | 27.10 | 26.71 | 26.57 | 26.95 |
| 20 | 25.74 | 24.66 | 24.65 | 24.72 | 24.65 | 23.68 | 24.72 | 25.37 | 25.16 | 27.30 | 26.88 | 25.43 | 24.65 | 25.60 | 24.94 | 24.83 | 25.74 |
| 22.5 | 24.61 | 22.84 | 23.39 | 23.37 | 23.32 | 22.87 | 22.84 | 23.18 | 23.56 | 25.09 | 24.75 | 23.28 | 22.53 | 23.58 | 22.95 | 23.18 | 24.61 |
| 25 | 22.67 | 21.19 | 21.55 | 21.94 | 21.82 | 20.60 | 21.20 | 21.23 | 21.23 | 23.08 | 22.76 | 20.98 | 20.34 | 21.41 | 20.72 | 21.36 | 22.67 |

TABLE 1-5-continued

| γ | c | | | | | | | | | | | | | | | | |
|---|---|---|---|---|---|---|---|---|---|---|---|---|---|---|---|---|---|
| | 0 | 22.5 | 45 | 67.5 | 90 | 112.5 | 135 | 157.5 | 180 | 202.5 | 225 | 247.5 | 270 | 292.5 | 315 | 337.5 | 360 |
| 27.5 | 20.65 | 19.13 | 19.95 | 20.26 | 20.15 | 19.06 | 18.85 | 18.89 | 18.76 | 20.65 | 19.77 | 18.40 | 17.94 | 19.46 | 18.88 | 19.23 | 20.65 |
| 30 | 18.55 | 17.31 | 17.86 | 18.07 | 18.24 | 16.64 | 16.58 | 16.63 | 16.21 | 18.22 | 17.50 | 16.47 | 15.53 | 16.77 | 16.49 | 17.34 | 18.55 |
| 32.5 | 16.37 | 14.84 | 15.43 | 16.05 | 16.07 | 13.40 | 14.54 | 13.84 | 13.08 | 15.71 | 14.80 | 13.88 | 12.90 | 14.45 | 14.11 | 14.66 | 16.37 |
| 35 | 13.87 | 12.11 | 12.66 | 13.35 | 13.32 | 11.29 | 11.41 | 11.06 | 10.60 | 12.92 | 11.67 | 10.80 | 10.28 | 11.53 | 11.04 | 12.06 | 13.87 |
| 37.5 | 10.96 | 9.39 | 9.81 | 10.91 | 10.74 | 9.03 | 8.75 | 8.42 | 7.84 | 9.85 | 9.18 | 7.79 | 7.65 | 9.28 | 8.50 | 9.45 | 10.96 |
| 40 | 8.38 | 6.67 | 7.21 | 8.13 | 8.41 | 6.11 | 6.41 | 5.49 | 5.00 | 7.34 | 6.27 | 5.14 | 4.81 | 6.66 | 6.12 | 6.77 | 8.38 |
| 42.5 | 5.23 | 3.86 | 5.12 | 5.78 | 5.75 | 3.52 | 3.51 | 2.70 | 1.94 | 4.27 | 3.71 | 2.48 | 2.04 | 3.44 | 3.05 | 4.01 | 5.23 |
| 45 | 2.89 | 1.38 | 2.52 | 3.25 | 3.08 | 1.10 | 0.69 | 0.01 | 0.46 | 1.55 | 0.80 | 0.17 | 0.66 | 0.75 | 0.28 | 1.49 | 2.89 |
| 47.5 | 0.39 | 1.09 | 0.25 | 0.89 | 0.67 | 1.74 | 2.05 | 2.35 | 3.52 | 1.60 | 2.11 | 2.68 | 3.44 | 1.57 | 2.10 | 1.19 | 0.39 |
| 50 | 2.03 | 4.06 | 2.59 | 2.22 | 2.08 | 3.84 | 4.39 | 4.76 | 6.14 | 4.11 | 4.74 | 5.69 | 5.70 | 4.27 | 4.32 | 3.80 | 2.03 |
| 52.5 | 4.94 | 6.12 | 5.53 | 4.41 | 4.33 | 6.19 | 6.58 | 7.32 | 8.40 | 6.82 | 7.23 | 7.99 | 8.18 | 6.59 | 7.01 | 6.40 | 4.94 |
| 55 | 7.28 | 8.44 | 7.45 | 6.43 | 6.58 | 8.45 | 8.78 | 9.65 | 10.65 | 9.04 | 9.65 | 10.28 | 10.15 | 8.76 | 8.86 | 8.14 | 7.28 |
| 57.5 | 9.22 | 10.83 | 9.72 | 8.62 | 8.74 | 10.72 | 10.81 | 11.46 | 13.13 | 11.69 | 12.13 | 12.43 | 12.19 | 11.00 | 10.93 | 10.34 | 9.22 |
| 60 | 11.88 | 13.06 | 11.73 | 11.23 | 11.07 | 12.50 | 13.24 | 13.87 | 14.58 | 13.48 | 13.84 | 14.58 | 14.45 | 13.17 | 13.24 | 12.55 | 11.88 |
| 62.5 | 13.33 | 14.79 | 13.66 | 12.75 | 13.24 | 14.28 | 15.04 | 15.83 | 16.11 | 15.55 | 15.97 | 16.16 | 15.84 | 14.52 | 14.85 | 14.21 | 13.33 |
| 65 | 15.27 | 16.19 | 15.16 | 14.69 | 14.40 | 15.98 | 16.45 | 17.11 | 17.86 | 17.20 | 17.53 | 17.81 | 17.44 | 16.47 | 16.54 | 15.79 | 15.27 |
| 67.5 | 16.80 | 17.68 | 16.84 | 16.20 | 16.23 | 17.03 | 17.78 | 18.31 | 19.32 | 18.70 | 19.17 | 19.03 | 18.83 | 17.96 | 17.54 | 17.13 | 16.80 |
| 70 | 18.34 | 18.75 | 17.76 | 17.21 | 17.57 | 18.81 | 18.87 | 19.67 | 20.63 | 20.13 | 20.31 | 20.03 | 19.85 | 18.86 | 18.84 | 18.31 | 18.34 |
| 72.5 | 19.31 | 19.99 | 19.44 | 18.47 | 18.90 | 19.38 | 20.28 | 20.57 | 21.43 | 21.28 | 21.16 | 21.18 | 20.65 | 20.43 | 19.84 | 19.65 | 19.31 |
| 75 | 20.19 | 20.81 | 20.19 | 19.57 | 19.48 | 20.43 | 20.59 | 21.40 | 22.37 | 22.06 | 22.08 | 22.25 | 21.38 | 20.73 | 20.61 | 20.68 | 20.19 |
| 77.5 | 21.24 | 21.47 | 20.78 | 20.07 | 20.40 | 20.76 | 21.61 | 21.70 | 22.30 | 22.85 | 22.65 | 22.54 | 21.89 | 21.33 | 20.99 | 21.07 | 21.24 |
| 80 | 21.16 | 21.31 | 21.20 | 20.58 | 21.06 | 21.48 | 21.84 | 22.00 | 22.59 | 23.42 | 23.29 | 22.76 | 22.25 | 22.16 | 21.69 | 21.70 | 21.16 |
| 82.5 | 22.21 | 21.64 | 21.12 | 21.42 | 21.23 | 21.24 | 21.77 | 22.15 | 22.88 | 23.64 | 23.50 | 23.04 | 22.62 | 22.38 | 21.84 | 21.70 | 22.21 |
| 85 | 21.89 | 21.56 | 21.45 | 21.42 | 21.15 | 21.73 | 21.92 | 22.53 | 22.59 | 23.85 | 23.43 | 23.04 | 22.47 | 22.23 | 21.84 | 21.78 | 21.89 |
| 87.5 | 22.21 | 21.23 | 21.12 | 21.34 | 21.23 | 21.16 | 21.61 | 21.85 | 22.74 | 23.35 | 23.29 | 22.76 | 22.18 | 22.01 | 21.92 | 21.47 | 22.21 |
| 90 | 21.65 | 21.14 | 21.12 | 21.25 | 20.81 | 20.59 | 20.98 | 21.33 | 21.94 | 23.28 | 23.15 | 21.90 | 21.53 | 21.78 | 20.99 | 21.62 | 21.65 |
| 92.5 | 21.48 | 19.99 | 20.53 | 20.83 | 20.65 | 19.79 | 20.44 | 20.80 | 21.14 | 22.64 | 22.29 | 21.39 | 20.65 | 21.33 | 20.38 | 20.68 | 21.48 |
| 95 | 20.27 | 19.58 | 19.44 | 20.07 | 19.90 | 19.54 | 19.65 | 20.04 | 19.90 | 21.71 | 21.51 | 20.60 | 20.29 | 20.58 | 19.84 | 19.89 | 20.27 |
| 97.5 | 19.55 | 18.50 | 18.60 | 19.23 | 19.48 | 18.49 | 18.95 | 19.29 | 18.88 | 20.49 | 20.31 | 19.53 | 18.83 | 19.16 | 18.84 | 18.39 | 19.55 |
| 100 | 18.90 | 17.27 | 17.76 | 17.80 | 18.07 | 16.79 | 18.01 | 18.01 | 17.93 | 19.63 | 19.17 | 18.02 | 17.95 | 18.34 | 17.46 | 17.76 | 18.90 |
| 102.5 | 17.69 | 15.94 | 16.76 | 17.13 | 17.23 | 15.90 | 16.13 | 16.81 | 16.19 | 18.42 | 17.60 | 16.80 | 16.05 | 16.92 | 16.46 | 16.50 | 17.69 |
| 105 | 16.24 | 14.38 | 15.08 | 15.27 | 15.49 | 14.61 | 15.04 | 14.85 | 14.73 | 16.70 | 16.18 | 14.65 | 14.45 | 15.12 | 14.85 | 15.23 | 16.24 |
| 107.5 | 14.70 | 12.81 | 13.74 | 13.76 | 13.82 | 12.82 | 13.24 | 13.34 | 12.84 | 15.27 | 14.62 | 13.36 | 12.70 | 13.85 | 13.16 | 13.18 | 14.70 |
| 110 | 12.36 | 11.08 | 11.64 | 12.50 | 12.49 | 10.72 | 10.97 | 11.38 | 10.80 | 13.41 | 12.56 | 11.50 | 10.80 | 11.98 | 11.24 | 11.37 | 12.36 |
| 112.5 | 10.83 | 8.68 | 9.47 | 10.64 | 10.66 | 8.37 | 9.17 | 9.20 | 8.62 | 11.05 | 10.43 | 9.28 | 8.83 | 10.10 | 9.09 | 9.63 | 10.83 |
| 115 | 8.65 | 6.45 | 7.20 | 8.20 | 8.66 | 6.43 | 6.98 | 6.79 | 6.36 | 9.11 | 8.01 | 7.20 | 6.06 | 7.93 | 6.86 | 7.35 | 8.65 |
| 117.5 | 6.07 | 4.31 | 5.61 | 6.10 | 6.24 | 3.84 | 4.55 | 4.31 | 3.59 | 6.61 | 6.02 | 4.26 | 3.80 | 5.24 | 5.17 | 5.06 | 6.07 |
| 120 | 3.89 | 1.42 | 2.59 | 3.07 | 3.58 | 1.57 | 2.05 | 1.67 | 0.75 | 3.96 | 2.75 | 1.60 | 1.32 | 3.14 | 2.10 | 2.85 | 3.89 |
| 122.5 | 1.14 | 1.38 | 0.26 | 1.30 | 1.00 | 1.02 | 0.69 | 1.04 | 1.36 | 1.10 | 0.34 | 1.12 | 1.89 | 0.45 | 0.21 | 0.33 | 1.14 |
| 125 | 1.36 | 4.11 | 3.27 | 1.99 | 1.83 | 4.01 | 3.74 | 4.13 | 4.78 | 1.62 | 2.79 | 4.06 | 4.52 | 2.77 | 3.43 | 2.59 | 1.36 |
| 127.5 | 4.26 | 7.16 | 6.04 | 4.51 | 5.08 | 6.84 | 6.80 | 6.54 | 7.69 | 4.77 | 5.56 | 7.00 | 7.43 | 5.31 | 6.20 | 5.12 | 4.26 |
| 130 | 7.09 | 10.13 | 9.23 | 7.88 | 7.58 | 10.16 | 9.85 | 10.15 | 11.19 | 7.84 | 9.11 | 9.94 | 11.01 | 8.31 | 9.73 | 8.51 | 7.09 |
| 132.5 | 10.40 | 13.35 | 12.08 | 10.91 | 11.08 | 13.07 | 12.82 | 13.32 | 14.24 | 11.21 | 12.31 | 13.53 | 13.93 | 11.60 | 12.73 | 11.58 | 10.40 |
| 135 | 13.55 | 16.98 | 15.43 | 14.20 | 14.07 | 16.80 | 16.50 | 16.56 | 17.81 | 14.71 | 15.30 | 17.11 | 17.57 | 15.19 | 15.27 | 15.76 | 13.55 |

In Tables 1-1 to 1-5, the experiment results of the aforementioned different thickness ratios are combined as shown in Table 2. In Table 2, when the thickness ratio of the lamp shade 20 is 1:1, the number of spatial coordinates not complying with (|I−Iavg|/Iavg)<25% is equal to 156, which is 16.68% of the total number of spatial coordinates, so that it does not meet the requirement of having at least 90% of the coordinates satisfying (|I−Iavg|/Iavg)<25%; when the thickness ratio of the lamp shade 20 is 1.7:1, the number of spatial coordinates not complying with (|I−Iavg|/Iavg)<25% is equal to 96 which is 10.26% of the total number of spatial coordinates, so that it does not meet the requirement of having at least 90% of the coordinates satisfying (|I−Iavg|/Iavg)<25%; when the thickness ratio of the lamp shade 20 is 1.8:1, the number of spatial coordinates not complying with (|I−Iavg|/Iavg)<25% is equal to 62, which is 6.63% of the total number of spatial coordinates, so that it meets the requirement of having at least 90% of the coordinates satisfying (|I−Iavg|/Iavg)<25%; when the thickness ratio of the lamp shade 20 is 3:1, the number of spatial coordinates not complying with (|I−Iavg|/Iavg)<25% is equal to 17, which is 1.81% of the total number of spatial coordinates, so that it meets the requirement of having at least 90% of the coordinates satisfying (|I−Iavg|/Iavg)<25%; and when the thickness ratio of the lamp shade 20 is 3.1:1, the number of spatial coordinates not complying with (|I−Iavg|/Iavg)<25% is equal to 145, which is 15.5% of the total number of spatial coordinates, so that it does not meet the requirement of having at least 90% of the coordinates satisfying (|I−Iavg|/Iavg)<25%.

TABLE 2

| Thickness Ratio | Whether or not complies with at least 90% of the coordinate satisfying (\|I − Iavg\|/Iavg) < 25% | Number of Coordinates Not Complying with the Relation/Total number of Coordinates |
|---|---|---|
| 1:1 | No | 156/935 = 16.68% |
| 1.7:1 | No | 96/935 = 10.26% |
| 1.8:1 | Yes | 62/935 = 6.63% |
| 3:1 | Yes | 17/935 = 1.81% |
| 3.1:1 | No | 145/935 = 15.5% |

In addition to the measurement of the numeric values of the light intensity I at each spatial position within the polar coordinate positions from 0 degree to 135 degrees, and the calculation of the numeric values of the relation of the average light intensity Iavg within the polar coordinate positions from 0 degree to 135 degrees, the present invention also measures the flux of the LED light sources 211 at the polar coordinate positions from 135 degrees to 180 degrees and calculates the total flux of the LED light sources 211 to obtain the numeric value of the cumulative percentage of the total flux at the polar coordinate positions from 135 degrees to 180 degrees. Experiments are performed for different thickness ratios of the lamp shade 20, and the experiment results are listed in Tables 3-1 to 3-5. Table 3-1 lists the experiment results for the thickness ratio of the lamp shade 20 equal to 1:1; Table 3-2 lists the experiment results for the thickness ratio of the lamp shade 20 equal to 1.7:1; Table 3-3 lists the experiment results for the thickness ratio of the lamp shade 20 equal to 1.8:1; Table 3-4 lists the experiment results for the thickness ratio of the lamp shade 20 equal to 3:1; and Table 3-5 lists the experiment results for the thickness ratio of the lamp shade 20 equal to 3.1:1, wherein γ(○) is the angle at the polar coordinate position; Average 1(cd) is the average light intensity at each angular position which is measured in the unit of candle (cd); Zonal F(lm) is the regional flux at each angular position, which is measured in the unit of lumen (lm); Sum F(lm) is the sequentially cumulative flux at each angular position, which is measured in the unit of lumen (lm); Eff Fiux(%) is the percentage (%) of the flux at each angular position with respect to the total flux; and Eff Sum(%) is the cumulative percentage of the flux at each angular position with respect to the total flux, which is measured in the unit of percent (%).

TABLE 3-1

| γ (°) | Average I (cd) | Zonal F (lm) | Sum F (lm) | Eff Flux (%) | Eff Sum (%) |
|---|---|---|---|---|---|
| 0.0 | 87.230 | .000 | .000 | .000% | .000% |
| 2.5 | 87.216 | .522 | .522 | .066% | .066% |
| 5.0 | 87.130 | 1.563 | 2.085 | .198% | .264% |
| 7.5 | 87.037 | 2.599 | 4.683 | .329% | .594% |
| 10.0 | 86.861 | 3.626 | 8.309 | .460% | 1.053% |
| 12.5 | 86.655 | 4.640 | 12.949 | .588% | 1.641% |
| 15.0 | 86.392 | 5.638 | 18.587 | .715% | 2.356% |
| 17.5 | 86.153 | 6.618 | 25.205 | .839% | 3.195% |
| 20.0 | 85.825 | 7.577 | 32.782 | .960% | 4.155% |
| 22.5 | 85.473 | 8.510 | 41.292 | 1.079% | 5.234% |
| 25.0 | 85.109 | 9.417 | 50.709 | 1.194% | 6.427% |
| 27.5 | 84.659 | 10.292 | 61.001 | 1.304% | 7.732% |
| 30.0 | 84.277 | 11.138 | 72.138 | 1.412% | 9.143% |
| 32.5 | 83.873 | 11.957 | 84.095 | 1.515% | 10.659% |
| 35.0 | 83.526 | 12.747 | 96.842 | 1.616% | 12.275% |
| 37.5 | 83.208 | 13.514 | 110.356 | 1.713% | 13.987% |
| 40.0 | 82.840 | 14.246 | 124.602 | 1.806% | 15.793% |
| 42.5 | 82.417 | 14.935 | 139.537 | 1.893% | 17.686% |
| 45.0 | 81.999 | 15.584 | 155.121 | 1.975% | 19.661% |
| 47.5 | 81.603 | 16.199 | 171.319 | 2.053% | 21.714% |
| 50.0 | 81.204 | 16.778 | 188.097 | 2.127% | 23.841% |
| 52.5 | 80.703 | 17.307 | 205.404 | 2.194% | 26.035% |
| 55.0 | 80.253 | 17.792 | 223.196 | 2.255% | 28.290% |
| 57.5 | 79.594 | 18.217 | 241.413 | 2.309% | 30.599% |
| 60.0 | 78.973 | 18.581 | 259.994 | 2.355% | 32.954% |
| 62.5 | 78.376 | 18.909 | 278.902 | 2.397% | 35.350% |
| 65.0 | 77.674 | 19.183 | 298.086 | 2.431% | 37.782% |
| 67.5 | 76.876 | 19.390 | 317.475 | 2.458% | 40.239% |
| 70.0 | 76.068 | 19.538 | 337.014 | 2.476% | 42.716% |
| 72.5 | 75.266 | 19.642 | 356.656 | 2.490% | 45.205% |
| 75.0 | 74.341 | 19.687 | 376.343 | 2.495% | 47.701% |
| 77.5 | 73.365 | 19.665 | 396.008 | 2.493% | 50.193% |
| 80.0 | 72.402 | 19.596 | 415.604 | 2.484% | 52.677% |
| 82.5 | 71.268 | 19.463 | 435.067 | 2.467% | 55.144% |
| 85.0 | 70.224 | 19.279 | 454.346 | 2.444% | 57.587% |
| 87.5 | 69.042 | 19.048 | 473.394 | 2.414% | 60.002% |
| 90.0 | 67.900 | 18.766 | 492.160 | 2.379% | 62.380% |
| 92.5 | 66.661 | 18.440 | 510.599 | 2.337% | 64.717% |
| 95.0 | 65.384 | 18.060 | 528.659 | 2.289% | 67.006% |
| 97.5 | 64.090 | 17.641 | 546.301 | 2.236% | 69.242% |
| 100.0 | 62.672 | 17.173 | 563.473 | 2.177% | 71.419% |
| 102.5 | 61.267 | 16.662 | 580.135 | 2.112% | 73.531% |

TABLE 3-1-continued

| γ (°) | Average I (cd) | Zonal F (lm) | Sum F (lm) | Eff Flux (%) | Eff Sum (%) |
|---|---|---|---|---|---|
| 105.0 | 59.714 | 16.107 | 596.242 | 2.042% | 75.572% |
| 107.5 | 58.227 | 15.520 | 611.762 | 1.967% | 77.539% |
| 110.0 | 56.712 | 14.918 | 626.680 | 1.891% | 79.430% |
| 112.5 | 55.033 | 14.275 | 640.955 | 1.809% | 81.240% |
| 115.0 | 53.468 | 13.612 | 654.568 | 1.725% | 82.965% |
| 117.5 | 51.763 | 12.936 | 667.504 | 1.640% | 84.605% |
| 120.0 | 50.108 | 12.242 | 679.746 | 1.552% | 86.156% |
| 122.5 | 48.297 | 11.531 | 691.277 | 1.462% | 87.618% |
| 125.0 | 46.567 | 10.811 | 702.088 | 1.370% | 88.988% |
| 127.5 | 44.788 | 10.098 | 712.187 | 1.280% | 90.268% |
| 130.0 | 43.012 | 9.385 | 721.527 | 1.190% | 91.458% |
| 132.5 | 41.214 | 8.680 | 730.252 | 1.100% | 92.558% |
| 135.0 | 39.375 | 7.979 | 738.231 | 1.011% | 93.569% |
| 137.5 | 37.648 | 7.301 | 745.531 | .925% | 94.494% |
| 140.0 | 35.950 | 6.651 | 752.183 | .843% | 95.337% |
| 142.5 | 34.166 | 6.015 | 758.198 | .762% | 96.100% |
| 145.0 | 32.490 | 5.402 | 763.601 | .685% | 96.785% |
| 147.5 | 30.798 | 4.819 | 768.420 | .611% | 97.396% |
| 150.0 | 29.000 | 4.252 | 772.672 | .539% | 97.934% |
| 152.5 | 27.237 | 3.708 | 776.380 | .470% | 98.404% |
| 155.0 | 25.087 | 3.172 | 779.552 | .402% | 98.806% |
| 157.5 | 22.776 | 2.642 | 782.194 | .335% | 99.141% |
| 160.0 | 20.135 | 2.132 | 784.326 | .270% | 99.412% |
| 162.5 | 17.534 | 1.660 | 785.985 | .210% | 99.622% |
| 165.0 | 14.779 | 1.239 | 787.225 | .157% | 99.779% |
| 167.5 | 11.544 | .858 | 788.082 | .109% | 99.888% |
| 170.0 | 8.035 | .524 | 788.606 | .066% | 99.954% |
| 172.5 | 4.195 | .255 | 788.861 | .032% | 99.986% |
| 175.0 | 1.220 | .081 | 788.942 | .010% | 99.997% |
| 177.5 | 1.047 | .020 | 788.962 | .003% | 99.999% |
| 180.0 | 1.052 | .006 | 788.968 | .001% | 100.000% |

TABLE 3-2

| γ (°) | Average I (cd) | Zonal F (lm) | Sum F (lm) | Eff Flux (%) | Eff Sum (%) |
|---|---|---|---|---|---|
| 0.0 | 72.256 | .000 | .000 | .000% | .000% |
| 2.5 | 72.280 | .432 | .432 | .054% | .054% |
| 5.0 | 72.361 | 1.297 | 1.729 | .163% | .218% |
| 7.5 | 72.397 | 2.160 | 3.889 | .272% | .490% |
| 10.0 | 72.548 | 3.022 | 6.911 | .381% | .871% |
| 12.5 | 72.668 | 3.883 | 10.794 | .489% | 1.361% |
| 15.0 | 72.871 | 4.741 | 15.536 | .598% | 1.958% |
| 17.5 | 73.137 | 5.600 | 21.136 | .706% | 2.664% |
| 20.0 | 73.338 | 6.453 | 27.589 | .813% | 3.477% |
| 22.5 | 73.582 | 7.299 | 34.888 | .920% | 4.397% |
| 25.0 | 73.845 | 8.138 | 43.027 | 1.026% | 5.423% |
| 27.5 | 74.119 | 8.970 | 51.997 | 1.131% | 6.554% |
| 30.0 | 74.441 | 9.794 | 61.791 | 1.234% | 7.788% |
| 32.5 | 74.832 | 10.614 | 72.405 | 1.338% | 9.126% |
| 35.0 | 75.206 | 11.425 | 83.830 | 1.440% | 10.566% |
| 37.5 | 75.580 | 12.221 | 96.052 | 1.540% | 12.106% |
| 40.0 | 75.846 | 12.991 | 109.043 | 1.637% | 13.744% |
| 42.5 | 76.139 | 13.736 | 122.779 | 1.731% | 15.475% |
| 45.0 | 76.432 | 14.461 | 137.240 | 1.823% | 17.298% |
| 47.5 | 76.640 | 15.156 | 152.396 | 1.910% | 19.208% |
| 50.0 | 76.811 | 15.814 | 168.209 | 1.993% | 21.201% |
| 52.5 | 76.933 | 16.435 | 184.644 | 2.071% | 23.273% |
| 55.0 | 76.993 | 17.015 | 201.659 | 2.145% | 25.417% |
| 57.5 | 76.993 | 17.549 | 219.208 | 2.212% | 27.629% |
| 60.0 | 76.933 | 18.037 | 237.245 | 2.273% | 29.902% |
| 62.5 | 76.809 | 18.475 | 255.720 | 2.329% | 32.231% |
| 65.0 | 76.627 | 18.862 | 274.582 | 2.377% | 34.608% |
| 67.5 | 76.258 | 19.181 | 293.763 | 2.418% | 37.026% |
| 70.0 | 75.992 | 19.450 | 313.213 | 2.451% | 39.477% |
| 72.5 | 75.531 | 19.667 | 332.879 | 2.479% | 41.956% |
| 75.0 | 75.008 | 19.810 | 352.689 | 2.497% | 44.453% |
| 77.5 | 74.422 | 19.895 | 372.584 | 2.508% | 46.961% |
| 80.0 | 73.709 | 19.914 | 392.498 | 2.510% | 49.471% |
| 82.5 | 73.020 | 19.878 | 412.375 | 2.505% | 51.976% |
| 85.0 | 72.212 | 19.788 | 432.164 | 2.494% | 54.470% |
| 87.5 | 71.344 | 19.635 | 451.798 | 2.475% | 56.945% |
| 90.0 | 70.346 | 19.417 | 471.215 | 2.447% | 59.392% |

TABLE 3-2-continued

| γ (°) | Average I (cd) | Zonal F (lm) | Sum F (lm) | Eff Flux (%) | Eff Sum (%) |
|---|---|---|---|---|---|
| 92.5 | 69.405 | 19.151 | 490.366 | 2.414% | 61.806% |
| 95.0 | 68.296 | 18.834 | 509.200 | 2.374% | 64.180% |
| 97.5 | 67.220 | 18.464 | 527.664 | 2.327% | 66.507% |
| 100.0 | 66.029 | 18.051 | 545.716 | 2.275% | 68.782% |
| 102.5 | 64.757 | 17.582 | 563.298 | 2.216% | 70.998% |
| 105.0 | 63.518 | 17.078 | 580.376 | 2.153% | 73.151% |
| 107.5 | 62.111 | 16.532 | 596.908 | 2.084% | 75.234% |
| 110.0 | 60.774 | 15.950 | 612.857 | 2.010% | 77.245% |
| 112.5 | 59.272 | 15.335 | 628.193 | 1.933% | 79.178% |
| 115.0 | 57.775 | 14.684 | 642.877 | 1.851% | 81.028% |
| 117.5 | 56.210 | 14.012 | 656.890 | 1.766% | 82.795% |
| 120.0 | 54.594 | 13.315 | 670.205 | 1.678% | 84.473% |
| 122.5 | 53.037 | 12.612 | 682.817 | 1.590% | 86.063% |
| 125.0 | 51.283 | 11.889 | 694.706 | 1.498% | 87.561% |
| 127.5 | 49.563 | 11.147 | 705.853 | 1.405% | 88.966% |
| 130.0 | 47.860 | 10.414 | 716.268 | 1.313% | 90.279% |
| 132.5 | 46.125 | 9.685 | 725.953 | 1.221% | 91.499% |
| 135.0 | 44.281 | 8.951 | 734.904 | 1.128% | 92.628% |
| 137.5 | 42.640 | 8.239 | 743.143 | 1.038% | 93.666% |
| 140.0 | 40.861 | 7.546 | 750.689 | .951% | 94.617% |
| 142.5 | 39.063 | 6.857 | 757.546 | .864% | 95.481% |
| 145.0 | 37.401 | 6.197 | 763.743 | .781% | 96.262% |
| 147.5 | 35.587 | 5.558 | 769.302 | .701% | 96.963% |
| 150.0 | 33.764 | 4.931 | 774.233 | .622% | 97.585% |
| 152.5 | 31.698 | 4.316 | 778.549 | .544% | 98.129% |
| 155.0 | 29.436 | 3.706 | 782.255 | .467% | 98.596% |
| 157.5 | 26.820 | 3.106 | 785.360 | .391% | 98.987% |
| 160.0 | 23.980 | 2.524 | 787.884 | .318% | 99.305% |
| 162.5 | 20.897 | 1.977 | 789.861 | .249% | 99.554% |
| 165.0 | 17.659 | 1.479 | 791.340 | .186% | 99.741% |
| 167.5 | 13.497 | 1.015 | 792.355 | .128% | 99.869% |
| 170.0 | 9.787 | .623 | 792.978 | .078% | 99.947% |
| 172.5 | 4.629 | .301 | 793.278 | .038% | 99.985% |
| 175.0 | 1.391 | .090 | 793.368 | .011% | 99.996% |
| 177.5 | 1.082 | .022 | 793.390 | .003% | 99.999% |
| 180.0 | 1.047 | .006 | 793.397 | .001% | 100.000% |

TABLE 3-3

| γ (°) | Average I (cd) | Zonal F (lm) | Sum F (lm) | Eff Flux (%) | Eff Sum (%) |
|---|---|---|---|---|---|
| 0.0 | 66.257 | .000 | .000 | .000% | .000% |
| 2.5 | 66.246 | .396 | .396 | .050% | .050% |
| 5.0 | 66.319 | 1.188 | 1.585 | .150% | .200% |
| 7.5 | 66.479 | 1.982 | 3.566 | .251% | .451% |
| 10.0 | 66.648 | 2.776 | 6.342 | .351% | .802% |
| 12.5 | 66.943 | 3.572 | 9.914 | .452% | 1.254% |
| 15.0 | 67.231 | 4.371 | 14.286 | .553% | 1.807% |
| 17.5 | 67.616 | 5.172 | 19.458 | .654% | 2.461% |
| 20.0 | 68.052 | 5.977 | 25.435 | .756% | 3.217% |
| 22.5 | 68.584 | 6.788 | 32.223 | .859% | 4.076% |
| 25.0 | 69.091 | 7.600 | 39.823 | .961% | 5.037% |
| 27.5 | 69.658 | 8.411 | 48.234 | 1.064% | 6.101% |
| 30.0 | 70.233 | 9.223 | 57.457 | 1.167% | 7.268% |
| 32.5 | 70.881 | 10.034 | 67.491 | 1.269% | 8.537% |
| 35.0 | 71.458 | 10.839 | 78.330 | 1.371% | 9.908% |
| 37.5 | 72.120 | 11.637 | 89.967 | 1.472% | 11.381% |
| 40.0 | 72.801 | 12.433 | 102.400 | 1.573% | 12.953% |
| 42.5 | 73.384 | 13.211 | 115.612 | 1.671% | 14.624% |
| 45.0 | 73.942 | 13.964 | 129.576 | 1.766% | 16.391% |
| 47.5 | 74.425 | 14.690 | 144.266 | 1.858% | 18.249% |
| 50.0 | 74.927 | 15.391 | 159.657 | 1.947% | 20.196% |
| 52.5 | 75.342 | 16.063 | 175.720 | 2.032% | 22.228% |
| 55.0 | 75.664 | 16.692 | 192.412 | 2.111% | 24.339% |
| 57.5 | 75.860 | 17.269 | 209.681 | 2.184% | 26.524% |
| 60.0 | 76.079 | 17.804 | 227.485 | 2.252% | 28.776% |
| 62.5 | 76.160 | 18.295 | 245.779 | 2.314% | 31.090% |
| 65.0 | 76.166 | 18.726 | 264.505 | 2.369% | 33.459% |
| 67.5 | 76.095 | 19.103 | 283.608 | 2.416% | 35.875% |
| 70.0 | 75.897 | 19.417 | 303.024 | 2.456% | 38.332% |
| 72.5 | 75.624 | 19.666 | 322.691 | 2.488% | 40.819% |
| 75.0 | 75.312 | 19.862 | 342.552 | 2.512% | 43.332% |
| 77.5 | 74.805 | 19.986 | 362.539 | 2.528% | 45.860% |

TABLE 3-3-continued

| γ (°) | Average I (cd) | Zonal F (lm) | Sum F (lm) | Eff Flux (%) | Eff Sum (%) |
|---|---|---|---|---|---|
| 80.0 | 74.262 | 20.040 | 382.578 | 2.535% | 48.395% |
| 82.5 | 73.636 | 20.036 | 402.614 | 2.534% | 50.929% |
| 85.0 | 72.952 | 19.973 | 422.587 | 2.527% | 53.456% |
| 87.5 | 72.049 | 19.832 | 442.420 | 2.509% | 55.965% |
| 90.0 | 71.236 | 19.635 | 462.055 | 2.484% | 58.448% |
| 92.5 | 70.224 | 19.385 | 481.440 | 2.452% | 60.900% |
| 95.0 | 69.235 | 19.074 | 500.514 | 2.413% | 63.313% |
| 97.5 | 68.139 | 18.717 | 519.231 | 2.368% | 65.681% |
| 100.0 | 67.030 | 18.312 | 537.543 | 2.316% | 67.997% |
| 102.5 | 65.755 | 17.851 | 555.394 | 2.258% | 70.255% |
| 105.0 | 64.467 | 17.338 | 572.732 | 2.193% | 72.448% |
| 107.5 | 63.109 | 16.788 | 589.519 | 2.124% | 74.572% |
| 110.0 | 61.669 | 16.195 | 605.715 | 2.049% | 76.621% |
| 112.5 | 60.185 | 15.567 | 621.281 | 1.969% | 78.590% |
| 115.0 | 58.621 | 14.905 | 636.186 | 1.885% | 80.475% |
| 117.5 | 57.148 | 14.232 | 650.418 | 1.800% | 82.276% |
| 120.0 | 55.413 | 13.526 | 663.945 | 1.711% | 83.987% |
| 122.5 | 53.805 | 12.798 | 676.743 | 1.619% | 85.606% |
| 125.0 | 52.091 | 12.069 | 688.811 | 1.527% | 87.132% |
| 127.5 | 50.388 | 11.328 | 700.139 | 1.433% | 88.565% |
| 130.0 | 48.622 | 10.584 | 710.723 | 1.339% | 89.904% |
| 132.5 | 46.927 | 9.847 | 720.569 | 1.246% | 91.149% |
| 135.0 | 44.997 | 9.102 | 729.671 | 1.151% | 92.301% |
| 137.5 | 43.394 | 8.378 | 738.049 | 1.060% | 93.361% |
| 140.0 | 41.564 | 7.678 | 745.727 | .971% | 94.332% |
| 142.5 | 39.730 | 6.974 | 752.701 | .882% | 95.214% |
| 145.0 | 38.079 | 6.306 | 759.008 | .798% | 96.012% |
| 147.5 | 36.311 | 5.665 | 764.672 | .717% | 96.728% |
| 150.0 | 34.488 | 5.034 | 769.707 | .637% | 97.365% |
| 152.5 | 32.224 | 4.398 | 774.105 | .556% | 97.922% |
| 155.0 | 29.651 | 3.751 | 777.856 | .474% | 98.396% |
| 157.5 | 27.571 | 3.159 | 781.015 | .400% | 98.796% |
| 160.0 | 26.028 | 2.663 | 783.677 | .337% | 99.132% |
| 162.5 | 24.851 | 2.242 | 785.919 | .284% | 99.416% |
| 165.0 | 23.085 | 1.839 | 787.758 | .233% | 99.649% |
| 167.5 | 19.419 | 1.385 | 789.142 | .175% | 99.824% |
| 170.0 | 12.526 | .854 | 789.997 | .108% | 99.932% |
| 172.5 | 5.833 | .383 | 790.380 | .048% | 99.980% |
| 175.0 | 1.882 | .115 | 790.495 | .015% | 99.995% |
| 177.5 | 1.665 | .032 | 790.526 | .004% | 99.999% |
| 180.0 | 1.708 | .010 | 790.536 | .001% | 100.000% |

TABLE 3-4

| γ (°) | Average I (cd) | Zonal F (lm) | Sum F (lm) | Eff Flux (%) | Eff Sum (%) |
|---|---|---|---|---|---|
| 0.0 | 47.399 | .000 | .000 | .000% | .000% |
| 2.5 | 47.535 | .284 | .284 | .039% | .039% |
| 5.0 | 47.662 | .853 | 1.137 | .116% | .155% |
| 7.5 | 47.885 | 1.426 | 2.563 | .194% | .349% |
| 10.0 | 48.289 | 2.005 | 4.568 | .273% | .623% |
| 12.5 | 48.793 | 2.596 | 7.164 | .354% | .977% |
| 15.0 | 49.384 | 3.199 | 10.363 | .436% | 1.412% |
| 17.5 | 50.152 | 3.818 | 14.181 | .520% | 1.933% |
| 20.0 | 50.854 | 4.450 | 18.631 | .607% | 2.539% |
| 22.5 | 51.608 | 5.090 | 23.721 | .694% | 3.233% |
| 25.0 | 52.465 | 5.745 | 29.466 | .783% | 4.016% |
| 27.5 | 53.455 | 6.421 | 35.887 | .875% | 4.892% |
| 30.0 | 54.393 | 7.110 | 42.997 | .969% | 5.861% |
| 32.5 | 55.527 | 7.816 | 50.813 | 1.065% | 6.926% |
| 35.0 | 56.788 | 8.553 | 59.366 | 1.166% | 8.092% |
| 37.5 | 57.870 | 9.293 | 68.659 | 1.267% | 9.358% |
| 40.0 | 59.065 | 10.032 | 78.691 | 1.367% | 10.726% |
| 42.5 | 60.242 | 10.782 | 89.474 | 1.470% | 12.196% |
| 45.0 | 61.436 | 11.533 | 101.007 | 1.572% | 13.768% |
| 47.5 | 62.471 | 12.268 | 113.275 | 1.672% | 15.440% |
| 50.0 | 63.507 | 12.982 | 126.257 | 1.770% | 17.209% |
| 52.5 | 64.538 | 13.688 | 139.945 | 1.866% | 19.075% |
| 55.0 | 65.465 | 14.370 | 154.315 | 1.959% | 21.034% |
| 57.5 | 66.363 | 15.024 | 169.339 | 2.048% | 23.082% |
| 60.0 | 67.081 | 15.637 | 184.976 | 2.131% | 25.213% |
| 62.5 | 67.833 | 16.213 | 201.189 | 2.210% | 27.423% |
| 65.0 | 68.486 | 16.758 | 217.947 | 2.284% | 29.707% |

TABLE 3-4-continued

| γ (°) | Average I (cd) | Zonal F (lm) | Sum F (lm) | Eff Flux (%) | Eff Sum (%) |
|---|---|---|---|---|---|
| 67.5 | 68.953 | 17.243 | 235.190 | 2.350% | 32.057% |
| 70.0 | 69.389 | 17.673 | 252.863 | 2.409% | 34.466% |
| 72.5 | 69.704 | 18.053 | 270.916 | 2.461% | 36.927% |
| 75.0 | 69.915 | 18.373 | 289.288 | 2.504% | 39.431% |
| 77.5 | 70.007 | 18.629 | 307.918 | 2.539% | 41.970% |
| 80.0 | 70.005 | 18.822 | 326.740 | 2.566% | 44.536% |
| 82.5 | 69.921 | 18.956 | 345.696 | 2.584% | 47.120% |
| 85.0 | 69.777 | 19.034 | 364.730 | 2.594% | 49.714% |
| 87.5 | 69.473 | 19.046 | 383.776 | 2.596% | 52.310% |
| 90.0 | 68.993 | 18.975 | 402.750 | 2.586% | 54.896% |
| 92.5 | 68.554 | 18.849 | 421.599 | 2.569% | 57.465% |
| 95.0 | 67.911 | 18.665 | 440.264 | 2.544% | 60.010% |
| 97.5 | 67.239 | 18.414 | 458.678 | 2.510% | 62.520% |
| 100.0 | 66.439 | 18.110 | 476.788 | 2.468% | 64.988% |
| 102.5 | 65.566 | 17.746 | 494.534 | 2.419% | 67.407% |
| 105.0 | 64.606 | 17.331 | 511.864 | 2.362% | 69.769% |
| 107.5 | 63.551 | 16.864 | 528.729 | 2.299% | 72.068% |
| 110.0 | 62.393 | 16.347 | 545.075 | 2.228% | 74.296% |
| 112.5 | 61.156 | 15.783 | 560.858 | 2.151% | 76.447% |
| 115.0 | 59.841 | 15.180 | 576.039 | 2.069% | 78.516% |
| 117.5 | 58.379 | 14.533 | 590.572 | 1.981% | 80.497% |
| 120.0 | 56.912 | 13.855 | 604.426 | 1.888% | 82.386% |
| 122.5 | 55.377 | 13.158 | 617.584 | 1.793% | 84.179% |
| 125.0 | 53.745 | 12.436 | 630.021 | 1.695% | 85.874% |
| 127.5 | 51.982 | 11.687 | 641.707 | 1.593% | 87.467% |
| 130.0 | 50.168 | 10.919 | 652.627 | 1.488% | 88.955% |
| 132.5 | 48.405 | 10.158 | 662.785 | 1.385% | 90.340% |
| 135.0 | 46.485 | 9.395 | 672.180 | 1.281% | 91.621% |
| 137.5 | 44.788 | 8.651 | 680.832 | 1.179% | 92.800% |
| 140.0 | 42.768 | 7.913 | 688.744 | 1.079% | 93.878% |
| 142.5 | 40.804 | 7.170 | 695.914 | .977% | 94.856% |
| 145.0 | 38.895 | 6.460 | 702.374 | .880% | 95.736% |
| 147.5 | 36.972 | 5.777 | 708.151 | .787% | 96.524% |
| 150.0 | 35.012 | 5.119 | 713.270 | .698% | 97.221% |
| 152.5 | 33.138 | 4.493 | 717.763 | .612% | 97.834% |
| 155.0 | 31.074 | 3.893 | 721.656 | .531% | 95.364% |
| 157.5 | 29.011 | 3.317 | 724.972 | .452% | 98.816% |
| 160.0 | 26.361 | 2.751 | 727.723 | .375% | 99.191% |
| 162.5 | 23.381 | 2.192 | 729.915 | .299% | 99.490% |
| 165.0 | 19.430 | 1.642 | 731.557 | .224% | 99.714% |
| 167.5 | 13.971 | 1.088 | 732.645 | .148% | 99.862% |
| 170.0 | 8.952 | .613 | 733.258 | .084% | 99.946% |
| 172.5 | 4.328 | .277 | 733.535 | .038% | 99.984% |
| 175.0 | 1.510 | .087 | 733.622 | .012% | 99.995% |
| 177.5 | 1.315 | .025 | 733.647 | .003% | 99.999% |
| 180.0 | 1.313 | .008 | 733.655 | .001% | 100.000% |

TABLE 3-5

| γ (°) | Average I (cd) | Zonal F (lm) | Sum F (lm) | Eff Flux (%) | Eff Sum (%) |
|---|---|---|---|---|---|
| 0.0 | 37.827 | .000 | .000 | .000% | .000% |
| 2.5 | 37.873 | .226 | .226 | .032% | .032% |
| 5.0 | 38.087 | .681 | .907 | .096% | .128% |
| 7.5 | 38.353 | 1.141 | 2.048 | .161% | .289% |
| 10.0 | 38.879 | 1.610 | 3.658 | .227% | .516% |
| 12.5 | 39.465 | 2.095 | 5.753 | .296% | .812% |
| 15.0 | 40.235 | 2.597 | 8.350 | .366% | 1.178% |
| 17.5 | 41.067 | 3.118 | 11.468 | .440% | 1.618% |
| 20.0 | 42.025 | 3.661 | 15.129 | .516% | 2.134% |
| 22.5 | 43.006 | 4.224 | 19.353 | .596% | 2.730% |
| 25.0 | 44.110 | 4.809 | 24.162 | .678% | 3.409% |
| 27.5 | 45.317 | 5.421 | 29.584 | .765% | 4.173% |
| 30.0 | 46.572 | 6.058 | 35.642 | .855% | 5.028% |
| 32.5 | 47.990 | 6.724 | 42.366 | .949% | 5.976% |
| 35.0 | 49.544 | 7.427 | 49.793 | 1.048% | 7.024% |
| 37.5 | 51.036 | 8.152 | 57.945 | 1.150% | 8.174% |
| 40.0 | 52.535 | 8.886 | 66.831 | 1.253% | 9.428% |
| 42.5 | 54.103 | 9.637 | 76.468 | 1.360% | 10.787% |
| 45.0 | 55.578 | 10.396 | 86.864 | 1.467% | 12.254% |
| 47.5 | 57.064 | 11.153 | 98.017 | 1.573% | 13.827% |
| 50.0 | 58.504 | 11.910 | 109.927 | 1.680% | 15.507% |
| 52.5 | 59.884 | 12.655 | 122.582 | 1.785% | 17.292% |

TABLE 3-5-continued

| γ (°) | Average I (cd) | Zonal F (lm) | Sum F (lm) | Eff Flux (%) | Eff Sum (%) |
|---|---|---|---|---|---|
| 55.0 | 61.099 | 13.373 | 135.955 | 1.887% | 19.179% |
| 57.5 | 62.344 | 14.068 | 150.023 | 1.985% | 21.164% |
| 60.0 | 63.551 | 14.752 | 164.776 | 2.081% | 23.245% |
| 62.5 | 64.522 | 15.390 | 180.166 | 2.171% | 25.416% |
| 65.0 | 65.427 | 15.975 | 196.141 | 2.254% | 27.669% |
| 67.5 | 66.222 | 16.517 | 212.658 | 2.330% | 29.999% |
| 70.0 | 66.902 | 17.006 | 229.664 | 2.399% | 32.398% |
| 72.5 | 67.532 | 17.449 | 247.113 | 2.461% | 34.860% |
| 75.0 | 67.984 | 17.833 | 264.945 | 2.516% | 37.375% |
| 77.5 | 68.291 | 18.144 | 283.089 | 2.559% | 39.935% |
| 80.0 | 68.532 | 18.394 | 301.482 | 2.595% | 42.530% |
| 82.5 | 68.668 | 18.587 | 320.069 | 2.622% | 45.152% |
| 85.0 | 68.684 | 18.715 | 338.784 | 2.640% | 47.792% |
| 87.5 | 68.562 | 18.772 | 357.555 | 2.648% | 50.440% |
| 90.0 | 68.334 | 18.760 | 376.315 | 2.646% | 53.086% |
| 92.5 | 67.979 | 18.680 | 394.994 | 2.635% | 55.721% |
| 95.0 | 67.551 | 18.537 | 413.531 | 2.615% | 58.336% |
| 97.5 | 66.973 | 18.329 | 431.860 | 2.586% | 60.922% |
| 100.0 | 66.355 | 18.062 | 449.922 | 2.548% | 63.470% |
| 102.5 | 65.633 | 17.744 | 467.666 | 2.503% | 65.973% |
| 105.0 | 64.730 | 17.356 | 485.023 | 2.448% | 68.421% |
| 107.5 | 63.830 | 16.917 | 501.940 | 2.387% | 70.808% |
| 110.0 | 62.759 | 16.430 | 518.370 | 2.318% | 73.126% |
| 112.5 | 61.606 | 15.887 | 534.258 | 2.241% | 75.367% |
| 115.0 | 60.348 | 15.300 | 549.558 | 2.158% | 77.525% |
| 117.5 | 59.027 | 14.675 | 564.233 | 2.070% | 79.595% |
| 120.0 | 57.536 | 14.007 | 578.240 | 1.976% | 81.571% |
| 122.5 | 56.072 | 13.313 | 591.553 | 1.878% | 83.449% |
| 125.0 | 54.396 | 12.590 | 604.143 | 1.776% | 85.225% |
| 127.5 | 52.804 | 11.850 | 615.992 | 1.672% | 86.897% |
| 130.0 | 50.995 | 11.096 | 627.088 | 1.565% | 88.462% |
| 132.5 | 49.222 | 10.328 | 637.415 | 1.457% | 89.919% |
| 135.0 | 47.302 | 9.557 | 646.972 | 1.348% | 91.267% |
| 137.5 | 45.504 | 8.796 | 655.769 | 1.241% | 92.508% |
| 140.0 | 43.589 | 8.052 | 663.821 | 1.136% | 93.644% |
| 142.5 | 41.623 | 7.311 | 671.131 | 1.031% | 94.675% |
| 145.0 | 39.598 | 6.583 | 677.714 | .929% | 95.604% |
| 147.5 | 37.599 | 5.879 | 683.593 | .829% | 96.433% |
| 150.0 | 35.481 | 5.196 | 688.789 | .733% | 97.166% |
| 152.5 | 33.246 | 4.531 | 693.320 | .639% | 97.806% |
| 155.0 | 30.819 | 3.884 | 697.204 | .548% | 98.353% |
| 157.5 | 28.064 | 3.251 | 700.455 | .459% | 98.812% |
| 160.0 | 25.103 | 2.641 | 703.096 | .373% | 99.185% |
| 162.5 | 22.112 | 2.080 | 705.176 | .293% | 99.478% |
| 165.0 | 18.554 | 1.560 | 706.736 | .220% | 99.698% |
| 167.5 | 14.215 | 1.068 | 707.803 | .151% | 99.849% |
| 170.0 | 9.385 | .631 | 708.434 | .089% | 99.938% |
| 172.5 | 5.353 | .307 | 708.742 | .043% | 99.981% |
| 175.0 | 1.605 | .104 | 708.846 | .015% | 99.996% |
| 177.5 | 1.077 | .024 | 708.870 | .003% | 99.999% |
| 180.0 | 1.068 | .006 | 708.876 | .001% | 100.000% |

From the numeric values listed in the cumulative fields of the flux at each angular position with respect to the total flux as shown in Tables 3-1 to 3-5, we know that when the thickness ratio of the lamp shade 20 is 1:1, the flux of the polar coordinate positions from 135 degrees to 180 degrees is approximately equal to 6.431% of the total flux of the LED light sources 211; when the thickness ratio of the lamp shade 20 is 1.7:1, the flux of the polar coordinate positions from 135 degrees to 180 degrees is approximately equal to 7.372% of the total flux of the LED light sources 211; when the thickness ratio of the lamp shade 20 is 1.8:1, the flux of the polar coordinate positions from 135 degrees to 180 degrees is approximately equal to 7.699% of the total flux of the LED light sources 211; when the thickness ratio of the lamp shade 20 is 3:1, the flux of the polar coordinate positions from 135 degrees to 180 degrees is approximately equal to 8.379% of the total flux of the LED light sources 211; and when the thickness ratio of the lamp shade 20 is 3.1:1, the flux of the polar coordinate positions from 135 degrees to 180 degrees is approximately equal to 8.733% of the total flux of the LED light sources 211. Although the flux of the testing items can reach up to 5% of the total flux of the LED light source 21 at the polar coordinate position from 135 degrees to 180 degrees provided that the thickness ratio of the lamp shade 20 is 1:1, 1.7:1, 1.8:1, 3:1 or 3.1:1, yet the present invention is characterized in that the axially symmetric LED light bulb 2 not just achieves a brightness with a flux equal to 5% of the total flux of the LED light sources 211 at the polar coordinate position from 135 degrees to 180 degrees only, but also satisfy the relation (|I−Iavg|/Iavg) <25%, wherein, I is an intensity of light of at least 90% of a spatial position between the polar coordinate positions from 0 degree to 135 degrees, and Iavg is an average light intensity between the polar coordinate positions from 0 degree to 135 degrees. With reference to the aforementioned experiment results, the expected illumination effect of the present invention has not been achieved when the lamp shade 20 has a thickness ratio of 1:1, 1.7:1 or 3.1:1.

Figure 8:
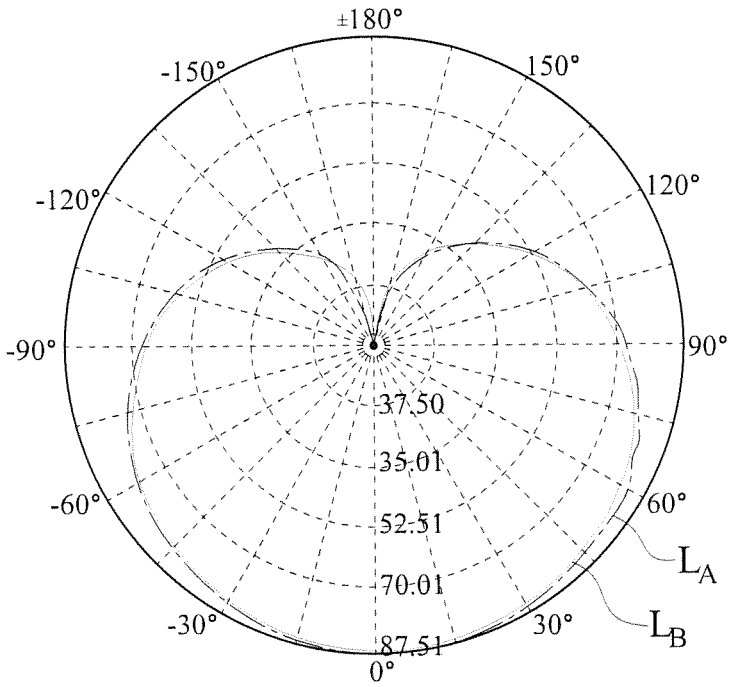
FIG. 8 shows the light pattern of a lamp shade of an axially symmetric LED light bulb of a preferred embodiment of the present invention with a thickness ratio of 1:1.
Figure 9:
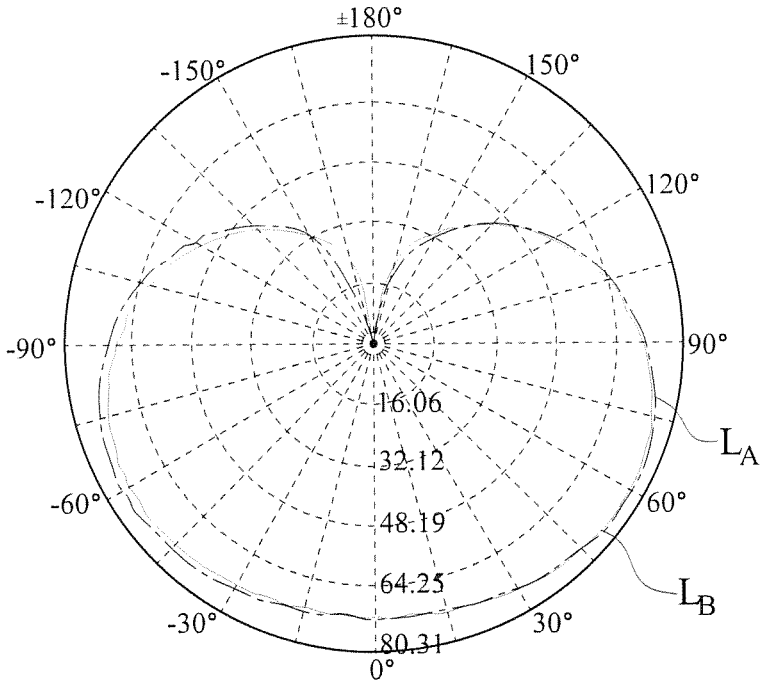
FIG. 9 shows the light pattern of a lamp shade of an axially symmetric LED light bulb of a preferred embodiment of the present invention with a thickness ratio of 1.7:1.
Figure 10:
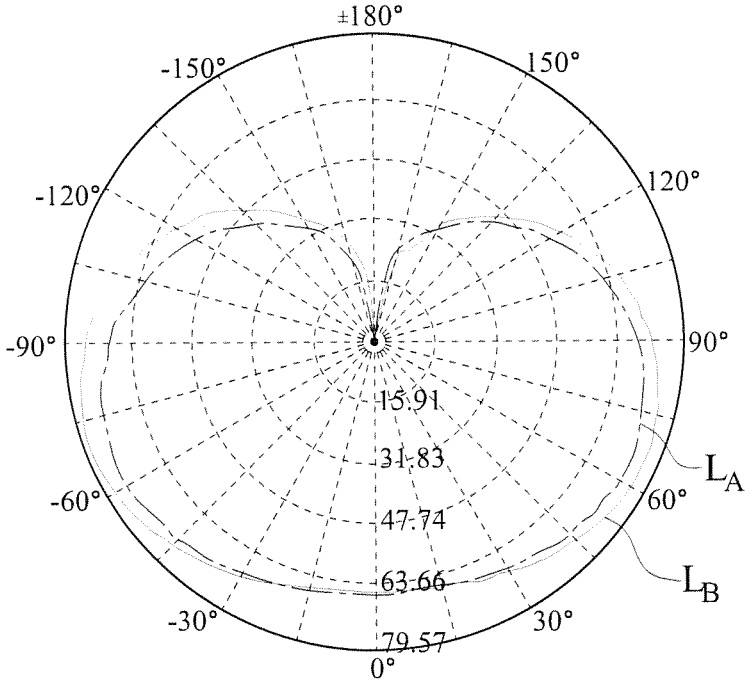
FIG. 10 shows the light pattern of a lamp shade of an axially symmetric LED light bulb of a preferred embodiment of the present invention with a thickness ratio of 1.8:1.
Figure 11:
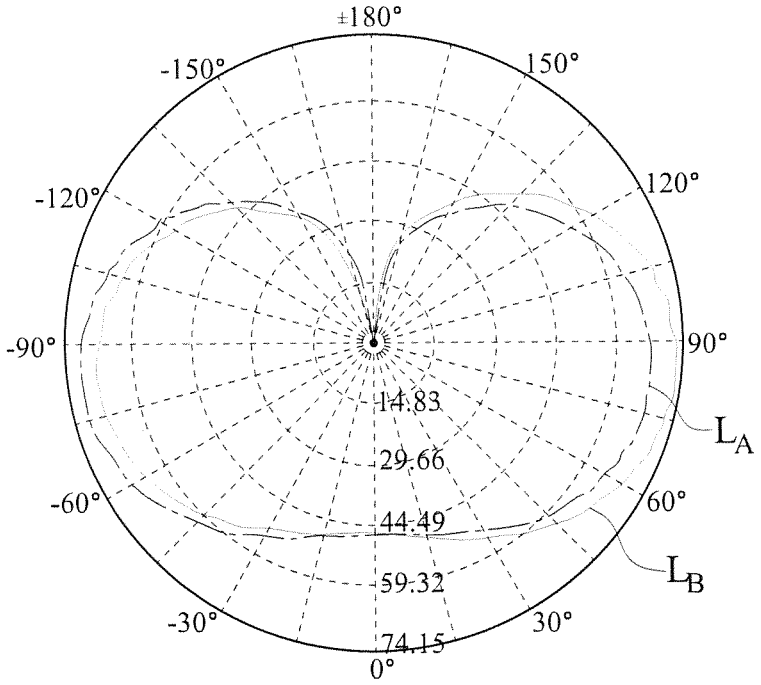
FIG. 11 shows the light pattern of a lamp shade of an axially symmetric LED light bulb of a preferred embodiment of the present invention with a thickness ratio of 3:1.
Figure 12:
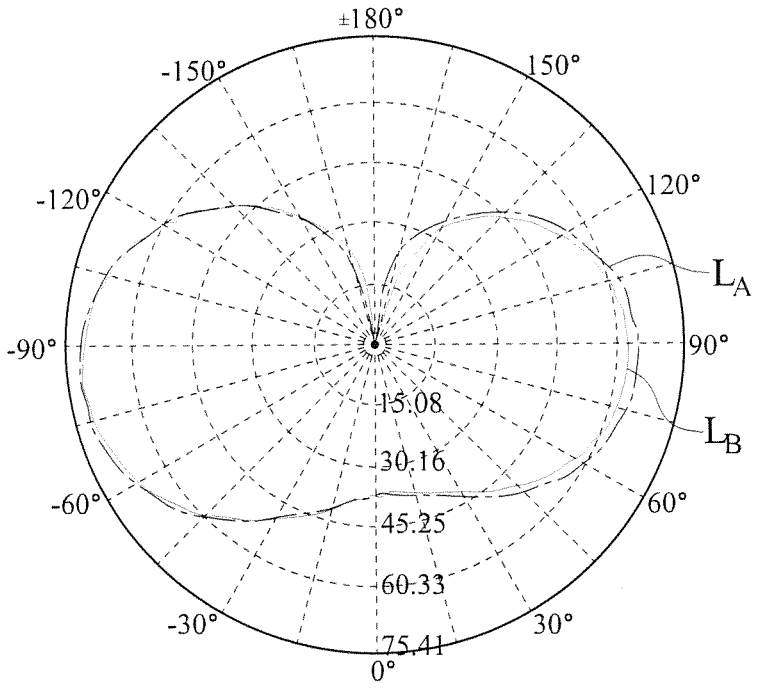
FIG. 12 shows the light pattern of a lamp shade of an axially symmetric LED light bulb of a preferred embodiment of the present invention with a thickness ratio of 3.1:1.

With reference to FIGS. 8-12 for different light polar radiation patterns drawn according to the experiment results respectively, these figures show the sectional light intensity distributions at the polar coordinate positions 0 degree and 180 degrees and the polar coordinate position 90 degrees and 270 degrees of the axially symmetric LED light bulb 2 respectively. In FIGS. 8-12, $L_A$ represents the light curve formed on a plane composed of the polar coordinate positions 0 degree and 180 degrees, and $L_B$ represents the light curve formed on a plane composed of the polar coordinate positions 90 degrees and 270 degrees. FIG. 8 shows a light polar radiation pattern of the lamp shade 20 with a thickness ratio of 1:1, FIG. 9 shows a light polar radiation pattern of the lamp shade 20 with a thickness ratio of 1.7:1, FIG. 10 shows a light polar radiation pattern of the lamp shade 20 with a thickness ratio of 1.8:1, FIG. 11 shows a light polar radiation pattern of the lamp shade 20 with a thickness ratio of 3:1, and FIG. 12 shows a light polar radiation pattern of the lamp shade 20 with a thickness ratio of 3.1:1. The se light polar radiation patterns show that both of the best light illumination range and uniformity will be achieved if the lamp shade 20 has the thickness ratios of 1.8:1 and 3:1, so that the LED light bulb with an LED light source can achieve an illumination effect similar to the full circumferential illumination effect. To achieve the expected full circumferential illumination effect, the present invention maintains a specific light emitting intensity and combines with the aforementioned experiment results to limit the thickness of the lamp shade 20 in a range of the polar coordinate +30 degrees to −30 degrees with respect to the polar coordinate +90 degrees to +30 degrees and −90 degrees to −30 degrees to a ratio of (1.8-3):1, so that the axially symmetric LED light bulb 2 satisfies the aforementioned flux and light emitting intensity conditions and achieves the best light emitting efficiency and uniformity.

Preferably, the edge of a sectional line on an inner side of the lamp shade 20 is an arc, or a curve having a plurality of turning points, wherein the curve is laterally symmetrical. In this preferred embodiment, the edge of the sectional line on the inner side of the lamp shade 20 is an arc. In addition, the distance L from the top of the inner side of the lamp shade 20 to the substrate 21 is 50 mm-60 mm, and the maximum width W of the external periphery of the lamp shade 20 is 58 mm-70 mm.

In summation of the description above, the present invention focuses at the LED light bulbs with a light emitting surface that faces upward, and makes use of the lamp shade 20 of unequal thickness to reduce the light intensity of the LED light sources 211 at specific angles to scatter the light to predetermined light output angle and achieve a uniform light emitting effect and a wide-angle illumination range, so as to overcome the drawbacks of the conventional LED light bulb including non-uniform light emission and too-concentrated light angle effectively.

What is claimed is:

1. An axially symmetric LED light bulb, comprising a lamp shade, a substrate and a connecting seat, and the substrate being installed on the connecting seat and having a plurality of LED light sources, and an edge of the lamp shade being coupled to the connecting seat and the substrate being covered inside the lamp shade, characterized in that the lamp shade has an unequal thickness, and the thickness of the top of the lamp shade is greater than the thickness of the lateral side of the lamp shade, such that the LED light sources are arranged at a polar coordinate origin position, and when the illumination of LED light source points at a direction towards the polar coordinate 0 degree and after the light of the LED light source passes through the lamp shade, at least 5% of the total flux of the LED light source is obtained at the polar coordinate positions from 135 degrees to 180 degrees; and the light of the LED light source passes through the lamp shade satisfies (|I−Iavg|/Iavg)<25%, wherein, I is an intensity of light of at least 90% of a spatial position between the polar coordinate positions from 0 degree to 135 degrees, and Iavg is an average light intensity between the polar coordinate positions from 0 degree to 135 degrees.

2. The axially symmetric LED light bulb as claimed in claim 1, wherein the ratio of the thickness of the lamp shade at the polar coordinates from +30 degrees to −30 degrees to the thickness of the lamp shade at the polar coordinates from +90 degrees to +30 degrees and from −90 degrees to −30 degrees is equal to (1.8-3):1.

3. The axially symmetric LED light bulb as claimed in claim 2, wherein the lamp shade has an arc-shaped cross-sectional edge formed on the inner side of the lamp shade.

4. The axially symmetric LED light bulb as claimed in claim 3, wherein the inner top end of the inner side of the lamp shade is 50 mm-60 mm apart from the substrate.

5. The axially symmetric LED light bulb as claimed in claim 4, wherein the lamp shade has an external periphery with a maximum width equal to 58 mm-70 mm.

6. The axially symmetric LED light bulb as claimed in claim 2, wherein the arc-shaped cross-sectional edge formed on the inner side of the lamp shade is a curve with a plurality of turning points, and the curve is bilaterally symmetrical.

7. The axially symmetric LED light bulb as claimed in claim 6, wherein the inner top end of the inner side of the lamp shade is 50 mm-60 mm apart from the substrate.

8. The axially symmetric LED light bulb as claimed in claim 7, wherein the lamp shade has an external periphery with a maximum width equal to 58 mm-70 mm.

* * * * *